US012171262B2

(12) United States Patent
Rostami et al.

(10) Patent No.: US 12,171,262 B2
(45) **Date of Patent: *Dec. 24, 2024**

(54) COMBINED CARTRIDGE FOR ELECTRONIC VAPING DEVICE

(71) Applicant: Altria Client Services LLC, Richmond, VA (US)

(72) Inventors: Ali Rostami, Glen Allen, VA (US); Christopher S. Tucker, Midlothian, VA (US); David Kane, Richmond, VA (US); Peter Lipowicz, Midlothian, VA (US); Georgios Karles, Richmond, VA (US); Gerd Kobal, Sandy Hook, VA (US); Yezdi Pithawalla, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/226,586

(22) Filed: Apr. 9, 2021

(65) Prior Publication Data

US 2021/0219611 A1 Jul. 22, 2021

Related U.S. Application Data

(63) Continuation of application No. 16/227,354, filed on Dec. 20, 2018, which is a continuation of application (Continued)

(51) Int. Cl.

*A24F 40/44* (2020.01)
*A24F 40/10* (2020.01)

(Continued)

(52) U.S. Cl.

CPC ..... *A24F 40/44* (2020.01); *A24F 40/30* (2020.01); *A24F 40/40* (2020.01); *A24F 40/42* (2020.01); *A24F 40/46* (2020.01); *A24F 40/10* (2020.01)

(58) Field of Classification Search

None

See application file for complete search history.

(56) References Cited

U.S. PATENT DOCUMENTS 1,771,366 A 7/1930 Wyss
1,968,509 A 7/1934 Tiffany (Continued)

FOREIGN PATENT DOCUMENTS

BE 421623 A 6/1937
CA 2947135 A1 11/2015

(Continued)

OTHER PUBLICATIONS

Chinese Office Action for corresponding Application No. 201780012415.2, dated Jan. 11, 2022, and English translation thereof.

(Continued)

*Primary Examiner* — Thor S Campbell

(74) *Attorney, Agent, or Firm* — Harness, Dickey & Pierce, P.L.C.

(57) ABSTRACT

A cartridge for an e-vaping device enables simultaneous vaporization of different pre-vapor formulations to form a vapor for vaping by an adult vaper. The cartridge includes a dispensing interface coupled to a plurality of reservoirs and a heater coupled to the dispensing interface in a housing. The dispensing interface may include a trunk and separate roots extending into separate reservoirs, such that the dispensing interface draws different pre-vapor formulations from the reservoirs to the trunk via the separate roots. The heater is (Continued)

coupled to the trunk, such that the heater is operable to simultaneously vaporize the different pre-vapor formulations drawn into the trunk.

12 Claims, 5 Drawing Sheets

Related U.S. Application Data

No. 15/063,900, filed on Mar. 8, 2016, now Pat. No. 10,368,580.

(51) Int. Cl.

| | |
|---|---|
| ***A24F 40/30*** | (2020.01) |
| ***A24F 40/40*** | (2020.01) |
| ***A24F 40/42*** | (2020.01) |
| ***A24F 40/46*** | (2020.01) |

(56) References Cited

U.S. PATENT DOCUMENTS 2,057,353 A 10/1936 Whittmore, Jr.
2,104,266 A 1/1938 McCormick
2,406,275 A 8/1946 Wejnarth
2,442,004 A 5/1948 Hayward-Butt
2,558,127 A 6/1951 Downs
2,642,313 A 6/1953 Montenier
2,728,981 A 1/1956 Hooper
2,830,597 A 4/1958 Kummli
2,907,686 A 10/1959 Siegel
2,971,039 A 2/1961 Western
2,972,557 A 2/1961 Toulman, Jr.
2,974,669 A 3/1961 Ellis
3,062,218 A 11/1962 Temkovits
3,200,819 A 8/1965 Gilbert
3,255,760 A 6/1966 Selke et al.
3,258,015 A 6/1966 Ellis et al.
3,356,094 A 12/1967 Ellis et al.
3,363,633 A 1/1968 Weber
3,402,723 A 9/1968 Hu
3,425,414 A 2/1969 La Roche
3,482,580 A 12/1969 Hollabaugh
3,633,881 A * 1/1972 Yurdin ..... A61L 9/122 261/24
3,812,854 A 5/1974 Michaels et al.
3,878,041 A 4/1975 Leitnaker et al.
3,949,743 A 4/1976 Shanbrom
4,068,672 A 1/1978 Guerra
4,077,784 A 3/1978 Vayrynen
4,083,372 A 4/1978 Boden
4,131,119 A 12/1978 Blasutti
4,141,369 A 2/1979 Burruss
4,164,230 A 8/1979 Pearlman
4,193,411 A 3/1980 Faris et al.
4,219,032 A 8/1980 Tabatznik et al.
4,246,913 A 1/1981 Ogden et al.
4,257,389 A 3/1981 Texidor et al.
4,259,970 A 4/1981 Green, Jr.
4,413,641 A 11/1983 Dwyer, Jr. et al.
4,419,302 A 12/1983 Nishino et al.
4,462,397 A 7/1984 Suzuki
4,629,604 A * 12/1986 Spector ..... A01M 1/2077 360/79
4,735,217 A 4/1988 Gerth et al.
4,765,347 A 8/1988 Sensabaugh, Jr. et al.
4,804,002 A 2/1989 Herron
4,846,199 A 7/1989 Rose
4,922,901 A 5/1990 Brooks et al.
4,945,929 A 8/1990 Egilmex
4,945,931 A 8/1990 Gori
4,947,874 A 8/1990 Brooks et al.
4,947,875 A 8/1990 Brooks et al.
4,961,727 A 10/1990 Beard
4,981,522 A 1/1991 Nichols et al.
4,991,606 A 2/1991 Serrano et al.
4,993,436 A 2/1991 Bloom, Jr.
5,016,656 A 5/1991 McMurtrie
5,040,552 A 8/1991 Schleich et al.
5,042,510 A 8/1991 Curtiss et al.
5,060,671 A 10/1991 Counts et al.
5,085,804 A 2/1992 Washburn
5,093,894 A 3/1992 Deevi et al.
5,095,921 A 3/1992 Losee et al.
5,139,594 A 8/1992 Rabin
5,144,962 A 9/1992 Counts et al.
5,156,170 A 10/1992 Clearman et al.
5,159,940 A 11/1992 Hayward et al.
5,179,966 A 1/1993 Losee et al.
5,224,498 A 7/1993 Deevi et al.
5,228,460 A 7/1993 Sprinkel et al.
5,235,157 A 8/1993 Blackburn
5,249,586 A 10/1993 Morgan et al.
5,259,062 A 11/1993 Pelonis
5,269,327 A 12/1993 Counts et al.
5,322,075 A 6/1994 Deevi et al.
5,353,813 A 10/1994 Deevi et al.
5,369,723 A 11/1994 Counts et al.
5,388,594 A 2/1995 Counts et al.
5,396,911 A 3/1995 Casey, III et al.
5,404,871 A 4/1995 Goodman et al.
5,408,574 A 4/1995 Deevi et al.
5,498,855 A 3/1996 Deevi et al.
5,505,214 A 4/1996 Collins et al.
5,542,410 A 8/1996 Goodman et al.
5,591,368 A 1/1997 Fleischhauer et al.
5,613,504 A 3/1997 Collins et al.
5,665,262 A 9/1997 Hajaligol et al.
5,666,977 A 9/1997 Higgins et al.
5,666,978 A 9/1997 Counts et al.
5,692,095 A * 11/1997 Young ..... F23D 11/445 431/208
5,743,251 A 4/1998 Howell et al.
5,797,390 A 8/1998 McSoley
5,865,185 A 2/1999 Collins et al.
5,878,752 A 3/1999 Adams et al.
5,894,841 A 4/1999 Voges
5,935,975 A 8/1999 Rose et al.
5,970,974 A 10/1999 Van Der Linden et al.
6,105,877 A 8/2000 Coffee
6,155,268 A 12/2000 Takeuchi
6,196,218 B1 3/2001 Voges
6,234,167 B1 5/2001 Cox et al.
6,386,674 B1 5/2002 Corrigan, III et al.
6,443,146 B1 9/2002 Voges
6,460,781 B1 10/2002 Garcia et al.
6,501,052 B2 12/2002 Cox et al.
6,516,796 B1 2/2003 Cox et al.
6,532,965 B1 3/2003 Abhulimen et al.
6,543,443 B1 4/2003 Klimowicz et al.
6,568,390 B2 5/2003 Nichols et al.
6,598,607 B2 7/2003 Adiga et al.
6,663,019 B2 12/2003 Garcia et al.
6,715,487 B2 4/2004 Nichols et al.
6,715,697 B2 4/2004 Duqueroie
6,772,756 B2 8/2004 Shayan
6,799,576 B2 10/2004 Farr
6,810,883 B2 11/2004 Felter et al.
6,830,383 B2 12/2004 Huang
6,854,470 B1 2/2005 Pu
6,886,557 B2 5/2005 Childers et al.
7,117,867 B2 10/2006 Cox et al.
7,131,599 B2 11/2006 Katase
7,167,641 B2 1/2007 Tam et al.
7,173,222 B2 2/2007 Cox et al.
7,195,403 B2 3/2007 Oki et al.
7,281,670 B2 * 10/2007 Lakatos ..... A61L 9/037 122/366
7,445,484 B2 11/2008 Wu
7,458,374 B2 12/2008 Hale et al.
D590,988 S 4/2009 Hon
D590,989 S 4/2009 Hon
D590,990 S 4/2009 Hon
D590,991 S 4/2009 Hon

(56) References Cited

U.S. PATENT DOCUMENTS 7,513,781 B2 4/2009 Galauner et al.
7,540,286 B2 * 6/2009 Cross ..... A61M 15/0045 128/203.26
7,614,402 B2 11/2009 Gomes
7,726,320 B2 6/2010 Robinson et al.
7,734,159 B2 6/2010 Beland et al.
7,780,041 B2 8/2010 Albisetti
7,832,410 B2 11/2010 Hon
7,845,359 B2 12/2010 Montaser
7,913,688 B2 3/2011 Cross et al.
7,920,777 B2 4/2011 Rabin et al.
7,997,280 B2 8/2011 Rosenthal
8,079,371 B2 12/2011 Robinson et al.
D655,036 S 2/2012 Zhou
8,127,772 B2 3/2012 Montaser
8,156,944 B2 4/2012 Han
8,205,622 B2 6/2012 Pan
8,258,192 B2 9/2012 Wu et al.
8,314,591 B2 11/2012 Terry et al.
8,320,751 B2 * 11/2012 Porchia ..... A61L 9/032 392/386
8,349,251 B2 1/2013 Woo et al.
8,365,742 B2 2/2013 Hon
8,367,959 B2 2/2013 Spertell
8,371,310 B2 2/2013 Brenneise
8,375,957 B2 2/2013 Hon
8,393,331 B2 3/2013 Hon
8,402,976 B2 3/2013 Fernando et al.
8,449,766 B2 5/2013 Feliers et al.
RE44,312 E * 6/2013 Vieira ..... A01M 1/2077 219/486
D684,311 S 6/2013 Liu
8,459,270 B2 6/2013 Coven et al.
8,483,553 B2 7/2013 Tollens et al.
8,498,524 B2 * 7/2013 Ruiz Ballesteros .... A61L 9/035 392/394
8,499,766 B1 8/2013 Newton
8,511,318 B2 8/2013 Hon
8,528,569 B1 9/2013 Newton
8,550,068 B2 10/2013 Terry et al.
8,550,069 B2 10/2013 Alelov
8,584,670 B2 11/2013 Hyde et al.
8,689,804 B2 4/2014 Fernando et al.
8,689,805 B2 4/2014 Hon
8,833,364 B2 9/2014 Buchberger
8,869,804 B2 10/2014 Mishra et al.
8,915,254 B2 12/2014 Monsees et al.
8,944,052 B2 2/2015 Osorio
9,017,091 B2 4/2015 Zhu et al.
9,271,528 B2 * 3/2016 Liu ..... A61M 11/042
9,271,529 B2 3/2016 Alima
9,498,002 B1 11/2016 Soreide
9,603,386 B2 3/2017 Xiang
9,675,114 B2 6/2017 Timmermans
9,675,117 B2 * 6/2017 Li ..... A24F 40/60
9,763,477 B2 * 9/2017 Zhu ..... H05B 3/141
9,808,032 B2 11/2017 Yamada et al.
9,877,508 B2 1/2018 Kane
9,888,714 B2 * 2/2018 Cameron ..... A24F 40/60
9,974,743 B2 5/2018 Rose et al.
10,015,986 B2 7/2018 Cadieux et al.
10,306,927 B2 6/2019 Rostami et al.
10,368,581 B2 * 8/2019 Rostami ..... A61M 15/0003
2002/0071871 A1 6/2002 Snyder et al.
2002/0078948 A1 6/2002 Hindle et al.
2002/0079309 A1 6/2002 Cox et al.
2002/0086852 A1 7/2002 Cantor et al.
2002/0146242 A1 * 10/2002 Vieira ..... A61L 9/037 392/395
2002/0170566 A1 11/2002 Farr
2002/0179102 A1 12/2002 Farr
2003/0056790 A1 3/2003 Nichols et al.
2003/0075188 A1 4/2003 Adiga et al.
2003/0150451 A1 8/2003 Shayan
2004/0050396 A1 3/2004 Squeo
2004/0247301 A1 * 12/2004 Yip ..... A61L 9/035 392/395
2005/0016550 A1 1/2005 Katase
2005/0150489 A1 7/2005 Dunfield et al.
2005/0235991 A1 10/2005 Nichols et al.
2005/0263618 A1 12/2005 Spallek et al.
2006/0054165 A1 3/2006 Hughes et al.
2006/0191546 A1 8/2006 Takano et al.
2006/0196518 A1 9/2006 Hon
2006/0213503 A1 9/2006 Borgschulte et al.
2007/0068523 A1 3/2007 Fishman
2007/0102013 A1 5/2007 Adams et al.
2007/0215168 A1 9/2007 Banerjee et al.
2007/0237499 A1 * 10/2007 DeWitt ..... F24F 6/10 392/395
2007/0267031 A1 11/2007 Hon
2007/0267032 A1 11/2007 Shan
2008/0022999 A1 1/2008 Belcastro et al.
2008/0029084 A1 2/2008 Costantino et al.
2008/0138398 A1 6/2008 Gonda
2008/0138399 A1 6/2008 Gonda
2008/0230052 A1 9/2008 Montaser
2008/0241255 A1 10/2008 Rose et al.
2008/0247892 A1 10/2008 Kawasumi
2008/0276947 A1 11/2008 Martzel
2008/0299048 A1 12/2008 Hale et al.
2009/0056729 A1 3/2009 Zawadzki et al.
2009/0095287 A1 4/2009 Emarlou
2009/0095311 A1 4/2009 Han
2009/0095312 A1 4/2009 Herbrich et al.
2009/0126745 A1 5/2009 Hon
2009/0130216 A1 5/2009 Cartt et al.
2009/0151717 A1 6/2009 Bowen et al.
2009/0162294 A1 6/2009 Werner
2009/0188490 A1 7/2009 Han
2009/0230117 A1 9/2009 Fernando et al.
2009/0255534 A1 10/2009 Paterno
2009/0272379 A1 11/2009 Thorens et al.
2009/0283103 A1 11/2009 Nielsen et al.
2010/0021900 A1 1/2010 Gong et al.
2010/0031968 A1 2/2010 Sheikh et al.
2010/0083959 A1 4/2010 Siller
2010/0126505 A1 5/2010 Rinker
2010/0163063 A1 7/2010 Fernando et al.
2010/0200006 A1 8/2010 Robinson et al.
2010/0200008 A1 8/2010 Taieb
2010/0206317 A1 8/2010 Albino et al.
2010/0229881 A1 9/2010 Hearn
2010/0242975 A1 9/2010 Hearn
2010/0242976 A1 9/2010 Katayama et al.
2010/0266643 A1 10/2010 Willett et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036346 A1 2/2011 Cohen et al.
2011/0036363 A1 2/2011 Urtsev et al.
2011/0041858 A1 2/2011 Montaser
2011/0094523 A1 4/2011 Thorens et al.
2011/0120482 A1 5/2011 Brenneise
2011/0155153 A1 6/2011 Thorens et al.
2011/0168172 A1 7/2011 Patton et al.
2011/0209717 A1 9/2011 Han
2011/0226236 A1 9/2011 Buchberger
2011/0232654 A1 9/2011 Mass
2011/0245493 A1 10/2011 Rabinowitz et al.
2011/0265806 A1 11/2011 Alarcon et al.
2011/0277756 A1 11/2011 Terry et al.
2011/0277757 A1 11/2011 Terry et al.
2011/0277760 A1 11/2011 Terry et al.
2011/0277761 A1 11/2011 Terry et al.
2011/0277764 A1 11/2011 Terry et al.
2011/0277780 A1 11/2011 Terry et al.
2011/0290244 A1 12/2011 Schennum
2011/0303231 A1 12/2011 Li et al.
2011/0304282 A1 12/2011 Li et al.
2011/0315152 A1 12/2011 Hearn et al.
2012/0006342 A1 1/2012 Rose et al.

(56) References Cited

U.S. PATENT DOCUMENTS

2012/0048266 A1 3/2012 Alelov
2012/0048466 A1 3/2012 Eckert et al.
2012/0111347 A1 5/2012 Hon
2012/0114809 A1 5/2012 Edwards et al.
2012/0118301 A1 5/2012 Montaser
2012/0145169 A1 6/2012 Wu
2012/0167906 A1 7/2012 Gysland
2012/0174914 A1 7/2012 Pirshafiey et al.
2012/0186594 A1 7/2012 Liu
2012/0199146 A1 8/2012 Marangos
2012/0199663 A1 8/2012 Qiu
2012/0207427 A1 8/2012 Ito
2012/0211015 A1 8/2012 Li et al.
2012/0227752 A1 9/2012 Alelov
2012/0230659 A1 9/2012 Goodman et al.
2012/0255567 A1 10/2012 Rose et al.
2012/0260927 A1 10/2012 Liu
2012/0285475 A1 11/2012 Liu
2012/0291791 A1 11/2012 Pradeep
2012/0312313 A1 12/2012 Frija
2012/0318882 A1 12/2012 Abehasera
2013/0014772 A1 1/2013 Liu
2013/0019887 A1 1/2013 Liu
2013/0025609 A1 1/2013 Liu
2013/0037041 A1 2/2013 Worm et al.
2013/0042865 A1 2/2013 Monsees et al.
2013/0056013 A1 3/2013 Terry et al.
2013/0074854 A1 3/2013 Lipowicz
2013/0152956 A1 6/2013 von Borstel et al.
2013/0192615 A1 8/2013 Tucker et al.
2013/0192616 A1 8/2013 Tucker et al.
2013/0192619 A1 8/2013 Tucker et al.
2013/0192620 A1 8/2013 Tucker et al.
2013/0192621 A1 8/2013 Li et al.
2013/0192622 A1 8/2013 Tucker et al.
2013/0192623 A1 8/2013 Tucker et al.
2013/0213418 A1 8/2013 Tucker et al.
2013/0213419 A1 8/2013 Tucker et al.
2013/0220315 A1 8/2013 Conley et al.
2013/0228191 A1 9/2013 Newton
2013/0284192 A1 10/2013 Peleg et al.
2013/0298905 A1 11/2013 Levin et al.
2013/0312778 A1 11/2013 Shibuichi
2013/0319407 A1 12/2013 Liu
2013/0319440 A1 12/2013 Capuano
2013/0340775 A1 12/2013 Juster et al.
2014/0000638 A1* 1/2014 Sebastian ..... A24F 40/50 131/328
2014/0014125 A1 1/2014 Fernando et al.
2014/0034071 A1 2/2014 Levitz et al.
2014/0060527 A1 3/2014 Liu
2014/0060556 A1 3/2014 Liu
2014/0081234 A1 3/2014 Eggert et al.
2014/0096782 A1 4/2014 Ampolini et al.
2014/0123989 A1* 5/2014 LaMothe ..... A61M 15/0003 131/328
2014/0153195 A1 6/2014 You et al.
2014/0163048 A1 6/2014 Barker et al.
2014/0166029 A1 6/2014 Weigensberg et al.
2014/0174441 A1 6/2014 Seeney et al.
2014/0190496 A1 7/2014 Wensley et al.
2014/0202474 A1 7/2014 Peleg et al.
2014/0209105 A1 7/2014 Sears et al.
2014/0224245 A1 8/2014 Alelov
2014/0246035 A1 9/2014 Minskoff et al.
2014/0261486 A1 9/2014 Potter et al.
2014/0261488 A1* 9/2014 Tucker ..... A24F 40/50 131/328
2014/0261492 A1 9/2014 Kane et al.
2014/0261788 A1 9/2014 Lewis et al.
2014/0267488 A1 9/2014 Ready et al.
2014/0366898 A1 12/2014 Monsees et al.
2015/0020823 A1 1/2015 Lipowicz et al.
2015/0027454 A1 1/2015 Li et al.
2015/0027468 A1 1/2015 Li et al.
2015/0027469 A1 1/2015 Tucker et al.
2015/0027470 A1 1/2015 Kane et al.
2015/0040929 A1 2/2015 Hon
2015/0047662 A1 2/2015 Hopps
2015/0068541 A1 3/2015 Sears et al.
2015/0068544 A1 3/2015 Moldoveanu et al.
2015/0117841 A1 4/2015 Brammer et al.
2015/0164141 A1 6/2015 Newton
2015/0196059 A1 7/2015 Liu
2015/0257447 A1 9/2015 Sullivan
2015/0257448 A1 9/2015 Lord
2015/0258289 A1 9/2015 Henry, Jr. et al.
2015/0313275 A1 11/2015 Anderson et al.
2015/0313281 A1 11/2015 Bonici et al.
2015/0320116 A1* 11/2015 Bleloch ..... A61M 11/042 219/628
2015/0335070 A1 11/2015 Sears et al.
2015/0351456 A1 12/2015 Johnson et al.
2015/0359263 A1 12/2015 Bellinger
2016/0007651 A1 1/2016 Ampolini et al.
2016/0021930 A1 1/2016 Minskoff et al.
2016/0106156 A1 4/2016 Qiu
2016/0109115 A1* 4/2016 Lipowicz ..... H05B 3/12 392/395
2016/0120224 A1 5/2016 Mishra et al.
2016/0135506 A1 5/2016 Sanchez et al.
2016/0174611 A1 6/2016 Monsees et al.
2016/0183598 A1* 6/2016 Tucker ..... A61M 15/06 392/404
2016/0192708 A1 7/2016 DeMeritt et al.
2016/0219938 A1 8/2016 Mamoun et al.
2016/0235123 A1 8/2016 Krietzman
2016/0285983 A1 9/2016 Liu
2016/0324216 A1 11/2016 Li et al.
2016/0331024 A1 11/2016 Cameron
2016/0331026 A1 11/2016 Cameron
2016/0331027 A1 11/2016 Cameron
2016/0331035 A1 11/2016 Cameron
2016/0331859 A1 11/2016 Cameron
2016/0334119 A1 11/2016 Cameron
2016/0337362 A1 11/2016 Cameron
2016/0338407 A1 11/2016 Kerdemelidis
2016/0345628 A1 12/2016 Sabet
2016/0360786 A1 12/2016 Bellinger et al.
2016/0363917 A1 12/2016 Blackley
2016/0374401 A1 12/2016 Liu
2017/0027232 A1 2/2017 Scheck et al.
2017/0042230 A1 2/2017 Cameron
2017/0042231 A1 2/2017 Cameron
2017/0042251 A1 2/2017 Yamada et al.
2017/0045994 A1 2/2017 Murison et al.
2017/0046357 A1 2/2017 Cameron
2017/0046738 A1 2/2017 Cameron
2017/0055588 A1 3/2017 Cameron
2017/0064999 A1 3/2017 Perez et al.
2017/0079327 A1 3/2017 Wu et al.
2017/0079329 A1 3/2017 Zitzke
2017/0086496 A1 3/2017 Cameron
2017/0086497 A1 3/2017 Cameron
2017/0086500 A1 3/2017 Li et al.
2017/0086503 A1 3/2017 Cameron
2017/0086504 A1 3/2017 Cameron
2017/0086505 A1 3/2017 Cameron
2017/0086507 A1 3/2017 Rado
2017/0091490 A1 3/2017 Cameron
2017/0092106 A1 3/2017 Cameron
2017/0093960 A1 3/2017 Cameron
2017/0093981 A1 3/2017 Cameron
2017/0109877 A1 4/2017 Peleg et al.
2017/0112197 A1 4/2017 Li et al.
2017/0119058 A1 5/2017 Cameron
2017/0127727 A1 5/2017 Davidson et al.
2017/0135400 A1 5/2017 Liu
2017/0135407 A1 5/2017 Cameron
2017/0135408 A1 5/2017 Cameron
2017/0135409 A1 5/2017 Cameron
2017/0135410 A1 5/2017 Cameron
2017/0135411 A1 5/2017 Cameron
2017/0135412 A1 5/2017 Cameron

(56) References Cited

U.S. PATENT DOCUMENTS

| | | | |
|---|---|---|---|
| 2017/0136193 | A1 | 5/2017 | Cameron |
| 2017/0136194 | A1 | 5/2017 | Cameron |
| 2017/0136301 | A1 | 5/2017 | Cameron |
| 2017/0143917 | A1 | 5/2017 | Cohen et al. |
| 2017/0150755 | A1 | 6/2017 | Batista |
| 2017/0150756 | A1 | 6/2017 | Rexroad et al. |
| 2017/0150758 | A1 | 6/2017 | Fernando et al. |
| 2017/0157341 | A1 | 6/2017 | Pandya et al. |
| 2017/0181467 | A1 | 6/2017 | Cameron |
| 2017/0181474 | A1 | 6/2017 | Cameron |
| 2017/0181475 | A1 | 6/2017 | Cameron |
| 2017/0185364 | A1 | 6/2017 | Cameron |
| 2017/0196270 | A1 | 7/2017 | Vick et al. |
| 2017/0208867 | A1 | 7/2017 | Li et al. |
| 2017/0215480 | A1 | 8/2017 | Qiu |
| 2017/0224020 | A1 | 8/2017 | Fernando et al. |
| 2017/0231280 | A1 | 8/2017 | Anton |
| 2017/0245550 | A1 | 8/2017 | Freelander |
| 2017/0245554 | A1 | 8/2017 | Perez et al. |
| 2017/0258136 | A1 | 9/2017 | Hawes et al. |
| 2017/0258142 | A1 | 9/2017 | Hatton et al. |
| 2017/0259170 | A1 | 9/2017 | Bowen et al. |
| 2017/0273357 | A1 | 9/2017 | Barbuck |
| 2017/0280779 | A1 | 10/2017 | Qiu |
| 2017/0290998 | A1* | 10/2017 | Poston ..... A61M 11/047 |
| 2017/0295844 | A1 | 10/2017 | Thevenaz et al. |
| 2017/0303590 | A1 | 10/2017 | Cameron et al. |
| 2017/0303593 | A1 | 10/2017 | Cameron et al. |
| 2017/0303594 | A1 | 10/2017 | Cameron et al. |
| 2017/0309091 | A1 | 10/2017 | Cameron et al. |
| 2017/0332702 | A1 | 11/2017 | Cameron et al. |
| 2017/0354180 | A1 | 12/2017 | Fornarelli |
| 2018/0000158 | A1 | 1/2018 | Ewing et al. |
| 2018/0007966 | A1 | 1/2018 | Li et al. |
| 2018/0027878 | A1 | 2/2018 | Dendy et al. |
| 2018/0092400 | A1 | 4/2018 | Sahin et al. |
| 2018/0177233 | A1 | 6/2018 | Tucker et al. |
| 2018/0235277 | A1 | 8/2018 | Lin et al. |
| 2019/0200674 | A1 | 7/2019 | Tucker et al. |
| 2019/0200675 | A1 | 7/2019 | Bache et al. |
| 2019/0387796 | A1 | 12/2019 | Cohen |
| 2020/0000146 | A1 | 1/2020 | Anderson et al. |
| 2022/0200854 | A1 | 6/2022 | Kane |
| 2022/0256694 | A1 | 8/2022 | Kambe et al. |

FOREIGN PATENT DOCUMENTS

| | | | |
|---|---|---|---|
| CH | 421786 | A | 9/1966 |
| CN | 87/104459 | A | 2/1988 |
| CN | 1323231 | A | 11/2001 |
| CN | 2719043 | Y | 8/2005 |
| CN | 2777995 | Y | 5/2006 |
| CN | 101043827 | A | 9/2007 |
| CN | 101084801 | A | 12/2007 |
| CN | 101115408 | A | 1/2008 |
| CN | 101116542 | A | 2/2008 |
| CN | 201018927 | Y | 2/2008 |
| CN | 201029436 | Y | 3/2008 |
| CN | 201054977 | Y | 5/2008 |
| CN | 201067079 | Y | 6/2008 |
| CN | 201076006 | Y | 6/2008 |
| CN | 201085044 | Y | 7/2008 |
| CN | 101518361 | A | 9/2009 |
| CN | 201379072 | Y | 1/2010 |
| CN | 201709398 | U | 1/2011 |
| CN | 201789924 | U | 4/2011 |
| CN | 201797997 | U | 4/2011 |
| CN | 102106611 | A | 6/2011 |
| CN | 201860753 | U | 6/2011 |
| CN | 102166044 | A | 8/2011 |
| CN | 202014571 | | 10/2011 |
| CN | 202014571 | U | 10/2011 |
| CN | 202014572 | | 10/2011 |
| CN | 202026804 | U | 11/2011 |
| CN | 102333462 | A | 1/2012 |
| CN | 202233005 | U | 5/2012 |
| CN | 202233007 | U | 5/2012 |
| CN | 102655773 | A | 9/2012 |
| CN | 102905569 | A | 1/2013 |
| CN | 202738816 | U | 2/2013 |
| CN | 103054196 | A | 4/2013 |
| CN | 202890463 | U | 4/2013 |
| CN | 103271448 | A | 9/2013 |
| CN | 203353683 | U | 12/2013 |
| CN | 203353685 | U | 12/2013 |
| CN | 203482901 | U | 3/2014 |
| CN | 103844359 | A | 6/2014 |
| CN | 103859609 | A | 6/2014 |
| CN | 203789157 | U | 8/2014 |
| CN | 104114049 | A | 10/2014 |
| CN | 203897285 | U | 10/2014 |
| CN | 104284606 | A | 1/2015 |
| CN | 204070536 | U | 1/2015 |
| CN | 104540406 | A | 4/2015 |
| CN | 204259827 | U | 4/2015 |
| CN | 204351068 | U | 5/2015 |
| CN | 104812260 | A | 7/2015 |
| CN | 104839893 | A | 8/2015 |
| CN | 104872822 | A | 9/2015 |
| CN | 104968225 | A | 10/2015 |
| CN | 104994757 | A | 10/2015 |
| CN | 105077590 | A | 11/2015 |
| CN | 105163610 | A | 12/2015 |
| CN | 105163611 | A | 12/2015 |
| CN | 204812033 | U | 12/2015 |
| CN | 204812043 | U | 12/2015 |
| CN | 105286088 | A | 2/2016 |
| CN | 105307520 | A | 2/2016 |
| CN | 105324045 | A | 2/2016 |
| CN | 105982355 | A | 10/2016 |
| DE | 2653133 | A1 | 5/1978 |
| DE | 3640917 | A1 | 8/1988 |
| DE | 3735704 | A1 | 5/1989 |
| DE | 19854009 | A1 | 5/2000 |
| EA | 019736 | B1 | 5/2014 |
| EP | 0893071 | A1 | 7/1908 |
| EP | 0277519 | A2 | 8/1988 |
| EP | 0295122 | A2 | 12/1988 |
| EP | 0358002 | A2 | 3/1990 |
| EP | 0358114 | A2 | 3/1990 |
| EP | 0430566 | A2 | 6/1991 |
| EP | 0845220 | A1 | 6/1998 |
| EP | 0857431 | A1 | 8/1998 |
| EP | 1989946 | | 11/2008 |
| EP | 1989946 | A1 | 11/2008 |
| EP | 2022350 | A1 | 2/2009 |
| EP | 2113178 | A1 | 11/2009 |
| EP | 2454956 | A1 | 5/2012 |
| EP | 2460424 | A1 | 6/2012 |
| EP | 2481308 | A1 | 8/2012 |
| EP | 2671461 | A1 | 12/2013 |
| EP | 2989912 | A1 | 3/2016 |
| GB | 680815 | A | 10/1952 |
| GB | 2148079 | A | 5/1985 |
| GB | 2513631 | A | 11/2014 |
| GB | 2524779 | A | 10/2015 |
| JP | 61068061 | A | 4/1986 |
| JP | H11-192702 | A | 7/1999 |
| JP | 2006/320286 | A | 11/2006 |
| JP | 2010-246946 | A | 11/2010 |
| JP | 2012-513750 | A | 6/2012 |
| JP | 2014-528717 | A | 10/2014 |
| JP | 2014-528718 | A | 10/2014 |
| JP | 2015-506182 | A | 3/2015 |
| JP | 2015-507695 | A | 3/2015 |
| JP | 2015-513970 | A | 5/2015 |
| JP | 2018-019695 | A | 2/2018 |
| KR | 100636287 | B1 | 10/2006 |
| KR | 10-2016-0008510 | A | 1/2016 |
| NL | 8201585 | A | 11/1982 |
| RU | 132954 | U1 | 10/2013 |
| RU | 2509516 | C2 | 3/2014 |
| RU | 2013124411 | A | 2/2015 |
| RU | 2013137741 | A | 2/2015 |

(56) References Cited

FOREIGN PATENT DOCUMENTS

| | | | |
|---|---|---|---|
| RU | 2014104166 | A | 9/2015 |
| WO | WO-86/02528 | A1 | 5/1986 |
| WO | WO-9003224 | A1 | 4/1990 |
| WO | WO-95/02970 | A1 | 2/1995 |
| WO | WO-97/42993 | A2 | 11/1997 |
| WO | WO-00/28843 | A1 | 5/2000 |
| WO | WO-03037412 | A2 | 5/2003 |
| WO | WO-2004/080216 | A1 | 9/2004 |
| WO | WO-2004/095955 | A1 | 11/2004 |
| WO | WO-2005/053444 | A1 | 6/2005 |
| WO | WO-2005/099494 | A1 | 10/2005 |
| WO | WO-2007/066374 | A1 | 6/2007 |
| WO | WO-2007/078273 | A1 | 7/2007 |
| WO | WO-2007/098337 | A2 | 8/2007 |
| WO | WO-2007/131449 | A1 | 11/2007 |
| WO | WO-2007/131450 | A1 | 11/2007 |
| WO | WO-2007/141668 | A2 | 12/2007 |
| WO | WO-2008/055423 | A1 | 5/2008 |
| WO | WO-2010091593 | A1 | 8/2010 |
| WO | WO-2010/107613 | A1 | 9/2010 |
| WO | WO-2010/145468 | A1 | 12/2010 |
| WO | WO-2011/124033 | A1 | 10/2011 |
| WO | WO-2011/125058 | A1 | 10/2011 |
| WO | WO-2011/146372 | A2 | 11/2011 |
| WO | WO-2012/129787 | A1 | 10/2012 |
| WO | WO-2012/129812 | A1 | 10/2012 |
| WO | WO-2012/142293 | A2 | 10/2012 |
| WO | WO-2012/174677 | A1 | 12/2012 |
| WO | WO-2013/022936 | A1 | 2/2013 |
| WO | WO-2013/027249 | A1 | 2/2013 |
| WO | WO-2013/116558 | | 8/2013 |
| WO | WO-2013116558 | A1 | 8/2013 |
| WO | WO-2013/152873 | A1 | 10/2013 |
| WO | WO-2014/004648 | A1 | 1/2014 |
| WO | WO-2014/032275 | A1 | 3/2014 |
| WO | WO-2014/110119 | A1 | 7/2014 |
| WO | WO-2014/110750 | A1 | 7/2014 |
| WO | WO-2014/151040 | A2 | 9/2014 |
| WO | WO-2014/187770 | A2 | 11/2014 |
| WO | WO-2015/040180 | A2 | 3/2015 |
| WO | WO-2015/046385 | A1 | 4/2015 |
| WO | WO-2015/079197 | A1 | 6/2015 |
| WO | WO-2015/112750 | A1 | 7/2015 |
| WO | WO-2015/138560 | A1 | 9/2015 |
| WO | WO-2015150699 | A1 | 10/2015 |
| WO | WO-2015/179388 | A1 | 11/2015 |
| WO | WO-2016/005601 | A1 | 1/2016 |
| WO | WO-2016/005602 | A1 | 1/2016 |
| WO | WO-2016015246 | A1 | 2/2016 |
| WO | WO-2016183573 | A1 | 11/2016 |
| WO | WO-2017/149152 | A1 | 9/2017 |

OTHER PUBLICATIONS

U.S. Office Action dated Feb. 1, 2022, for corresponding U.S. Appl. No. 16/449,897.

Chinese Office Action for corresponding Application No. 201780016476.6, dated Jan. 7, 2022, and English translation thereof.

European Notice of Allowance for corresponding Application No. 17710246.4, dated Jan. 20, 2022.

International Search Report and Written Opinion for PCT/US2013/027424 dated Apr. 25, 2013.

Lee et al., Technique for aerosol generation with controllable micrometer size distribution, Chemosphere 73 (2008). pp. 760-767.

International Preliminary Report on Patentability for PCT/US2013/027424 dated Sep. 4, 2014.

International Search Report and Written Opinion for PCT/US2013/022330 dated Jul. 15, 2014.

International Search Report dated Jul. 15, 2014.

Moroccan Examination Report Application No. 38386 dated Mar. 18, 2016.

Moroccan Notification of a Preliminary Search Report with Opinion on Patentability on Application No. 38386 dated Dec. 23, 2015.

Chinese Office Action dated Apr. 1, 2017 issued in corresponding Chinese Patent Application No. 201480016196.1 (with translation).

IntlInternational Search Report and Written Opinion dated May 9, 2017 issued in corresponding PCT Application No. PCT/EP2017/055102.

International Search Report and Written Opinion dated Jun. 8, 2017 issued in corresponding International Application No. PCT/EP2017/055472.

International Search Report and Written Opinion dated May 24, 2017 issued in corresponding International Application No. PCT/EP2017/055734.

International Search Report and Written Opinion for PCT/EP2017/055725 dated Jun. 13, 2017.

International Search Report and Written Opinion for PCT/EP2017/055733 dated Jun. 21, 2017.

Invitation to Pay Additional Fees for PCT/EP2017/055098 dated May 10, 2017.

International Search Report and Written Opinion for PCT/EP2017/055098 dated Jul. 14, 2017.

International Search Report and Written Opinion for PCT/EP2017/055100 dated Jun. 19, 2017.

Office Action for corresponding Russian Application No. 2015144179 dated Jul. 11, 2017 and English translation thereof.

Office Action for corresponding U.S. Appl. No. 15/067,990 dated Mar. 19, 2018.

Office Action for corresponding U.S. Appl. No. 15/059,791 dated Mar. 21, 2018.

Office Action dated Mar. 21, 2018 issued in corresponging U.S. Appl. No. 15/059,790.

U.S. Office Action issued in co-pending U.S. Appl. No. 15/063,900 dated Apr. 24, 2018.

Office Action for corresponding U.S. Appl. No. 15/067,810 dated Jun. 29, 2018.

Non-Final Office Action dated Aug. 3, 2018 in U.S. Appl. No. 15/067,867.

Non-Final Office Action dated Sep. 28, 2018 in U.S. Appl. No. 15/059,790.

Communication Pursuant to Rule 114(2) dated Oct. 1, 2018 in European Application No. 17710247.2.

U.S. Office Action dated Nov. 9, 2018 issued in co-pending U.S. Appl. No. 15/059,791.

U.S. Office Action dated Nov. 16, 2018 issued in co-pending U.S. Appl. No. 15/067,990.

Lee, Y, Jeng, F and Chen, C. "Technique for aerosol generation with controllable micrometer size distribution", Chemosphere 73 (2008) 760-767.

Office Action for corresponding U.S. Appl. No. 14/199,365 dated Jun. 20, 2016.

Office Action for corresponding Chinese Application No. 201480016196.1 dated Apr. 1, 2017 and English translation thereof.

International Search Report for corresponding International Application No. PCT/EP2017/055102 dated May 9, 2017.

International Search Report and Written Opinion for corresponding International Application No. PCT/EP2017/055472 dated Jun. 8, 2017.

International Search Report and Written Opinion for corresponding International application No. PCT/EP2017/055725 dated Jun. 13, 2017.

International Search Report for corresponding International Application No. PCT/EP2017/055733 dated Jun. 21, 2017.

International Search Report for corresponding Internation Application No. PCT/EP2017/055100 and dated Jun. 19, 2017.

International Search Report for corresponding International Application No. PCT/EP2017/055098 dated Jul. 14, 2017.

Partial International Search Report for corresponding International Application No. PCT/EP2017/055098 dated May 10, 2017.

Official Action for corresponding Russian Application No. 2015144179 dated Jul. 11, 2017 and English translation thereof.

U.S. Office Action for corresponding U.S. Appl. No. 15/059,790 dated Mar. 21, 2018.

U.S. Office Action for corresponding U.S. Appl. No. 15/059,791 dated Mar. 21, 2018.

(56) References Cited

OTHER PUBLICATIONS

Non-Final Office Action dated Apr. 24, 2018 in U.S. Appl. No. 15/063,900.
Non-Final Office Action dated Jun. 29, 2018 in U.S. Appl. No. 15/067,810.
Non-Final Office Action for corresponding U.S. Appl. No. 15/059,790 dated Sep. 28, 2018.
Chinese Office Action dated Apr. 1, 2017 issued in corresponding Chinese Patent Application No. 201480016196.1 (English translation provided).
U.S. Office Action dated Jun. 20, 2016 issued in co-pending U.S. Appl. No. 14/199,365.
Lee, et al. "Technique for aerosol generation with controllable micrometer size distribution," Chemosphere, vol. 73, pp. 760-767 (2008).
Moroccan Notification of Preliminary Search Report with Opinion on Patentability on Application No. 38386 dated Dec. 23, 2015.
International Search Report dated Jul. 15, 2014 issued in International Application No. PCT/US2014/0022330.
International Search Report and Written Opinion dated Jun. 8, 2017 issued in International Application No. PCT/EP2017/055472.
International Search Report and Written Opinion dated Jun. 13, 2017 issued in International Application No. PCT/EP2017/055725.
International Search Report and Written Opinion dated Jun. 21, 2017 issued in International Application No. PCT/EP2017/055733.
International Search Report and Written Opinion dated Jun. 19, 2017 issued in International Application No. PCT/EP2017/055100.
International Search Report and Written Opinion dated May 10, 2017 issued in International Application No. PCT/EP2017/055098.
International Search Report and Written Opinion dated Jul. 14, 2017 issued in International Application No. PCT/EP2017/055098.
Russian Office Action dated Jul. 11, 2017 issued in corresponding Russian Application No. 2015144179.
U.S. Office Action dated Mar. 21, 2018 issued in copending U.S. Appl. No. 15/059,790.
U.S. Office Action dated Mar. 19, 2018 issued in copending U.S. Appl. No. 15/067,990.
U.S. Office Action dated Apr. 24, 2018 issued in co-pending U.S. Appl. No. 15/063,900.
U.S. Office Action dated Jun. 29, 2018 issued in copending U.S. Appl. No. 15/067,810.
U.S. Office Action dated Aug. 3, 2018 issued in co-pending U.S. Appl. No. 15/067,867.
U.S. Office Action dated Sep. 28, 2018 issued in co-pending U.S. Appl. No. 15/059,790.
U.S. Office Action dated Dec. 27, 2018 issued in co-pending U.S. Appl. No. 15/059,746.
U.S. Office Action dated Mar. 21, 2019 issued in co-pending U.S. Appl. No. 15/059,790.
U.S. Office Action dated Apr. 5, 2019 for corresponding U.S. Appl. No. 15/067,990.
Notice of Allowance dated Apr. 23, 2019 for corresponding U.S. Appl. No. 15/059,791.
U.S. Notice of Allowance dated May 2, 2019 for corresponding U.S. Appl. No. 15/067,867.
U.S. Notice of Allowance dated May 3, 2019 for corresponding U.S. Appl. No. 15/059,746.
U.S. Notice of Allowance dated May 7, 2019 for corresponding U.S. Appl. No. 15/067,810.
U.S. Notice of Allowance dated May 16, 2019 for corresponding U.S. Appl. No. 15/063,900.
U.S. Notice of Allowance dated Aug. 14, 2019 for corresponding U.S. Appl. No. 15/059,791.
European Office Action dated Nov. 4, 2019 for corresponding European Application No. 17710247.2.
Decision to Grant a Patent dated Oct. 22, 2019 for corresponding Kazakhstan Application No. 2018/0692.1.
Kazakhstan Notice of Allowance dated Apr. 11. 2019 for corresonding Kazakhstan Application No. 2018/00693.1.
Third Party Observation dated Nov. 22, 2019 for corresponding Japanese Application No. 2018-546509.
U.S. Office Action dated Jan. 10, 2020 for corresponding U.S. Appl. No. 15/067,990.
European Third Party Observation dated Mar. 6, 2020 for corresponding European Application No. 17710242.3.
Russian Notice of Allowance dated Mar. 17, 2020 for corresponding Russian Application No. 2018134051/12(055982).
Russian Search Report dated Mar. 17, 2020 for corresponding Russian Application No. 2018134051/12(055982).
Russian Search Report dated Mar. 10, 2020 for corresponding Russian Application No. 2018135744/12(058874).
Russian Notice of Allowance and Search Report dated Apr. 27, 2020 for corresponding Russian Application No. 2018134604.
Russian Notice of Allowance and Search Report dated May 13, 2020 for corresponding Russian Application No. 2018135684.
Russian Notice of Allowance and Search Report dated May 22, 2020 for corresponding Russian Application No. 2018134598.
Extended European Search Report dated May 28, 2020 for corresponding European Application No. 20159607.9.
U.S. Notice of Allowance dated Jun. 26, 2020 for corresponding U.S. Appl. No. 15/067,990.
Russian Notice of Allowance and Search Report dated May 13, 2020 for corresponding Russian Application No. 2018134143.
Russian Office Action dated Jun. 5, 2020 for corresponding Russian Application No. 2018135744.
Russian Office Action and Search Report dated May 27, 2020 for corresponding Russian Application No. 2018133689.
U.S. Office Action dated Sep. 16, 2020 for corresponding U.S. Appl. No. 16/227,354.
Chinese Office Action and search report dated Sep. 16, 2020 for corresponding Chinese Application No. 201780016476.6 and English translation thereof.
Chinese Office Action and search report dated Sep. 15, 2020 for corresponding Chinese Application No. 201780010772.5 and English translation thereof.
Chinese Office Action and search report dated Sep. 17, 2020 for corresponding Chinese Application No. 201780011432.4 and English translation thereof.
Chinese Office Action and search report dated Sep. 25, 2020 for corresponding Chinese Application No. 201780013171.X and English translation thereof.
Chinese Office Action dated Oct. 10, 2020 for corresponding Chinese Application No. 201780012415.2, and English-language translation thereof.
Chinese Office Action dated Oct. 14, 2020 for corresponding Chinese Application No. 201780010768.9, and English-language translation thereof.
Russian Office Action dated Oct. 9, 2020 for corresponding Russian Application No. 2018135744, and English-language translation thereof.
Russian Notice of Allowance dated Nov. 25, 2020 for corresponding Russian Application No. 2018133689, and English-language translation thereof.
European Communication of a Notice of Opposition dated Dec. 4, 2020 for corresponding European Application No. 17708784.8.
U.S. Notice of Allowance dated Jan. 6, 2021 for corresponding U.S. Appl. No. 16/227,354.
Chinese Office Action dated Jan. 6, 2021 for corresponding Chinese Application No. 201780011672.4, and English-language translation thereof.
Zhu Donglai Yunnan University Press, "electronic cigarette", published Aug. 31, 2015, pp. 544-546.
Communication of a notice of opposition dated Feb. 18, 2021 for corresponding European Application No. 17710242.3.
Goniewicz, Maciej L., et al., "Nicotine Levels in Electronic Cigarettes", Jan. 2013, available online: https://academic.oup.com/ntr/article/15/1/158/1105400.
"USB Power Delivery Specification 1.0", Jul. 16, 2012, available online on Dec. 22, 2015 at http://www.usb.org/developers/powerdelivery/PD_1.0_Introduction.pdf; proof and document avail-

(56) References Cited

OTHER PUBLICATIONS able at https://web.archive.org/web/20151222214237/http://www.usb.org/developers/powerdelivery/PD_1.0_Introduction.pdf; retrieved at Feb. 1, 2021.
Wikipedia: USB, Revision of Dec. 23, 2015, available online: https://wikipedia.org/w/index.php?title=USB&oldid=696458466, retrieved on Feb. 1, 2021.
Brief Communication—Letter from the Opponent, dated Feb. 19, 2021 for corresponding European Application No. 17710242.3.
Japanese Decision to Grant dated Mar. 11, 2021 for corresponding Japanese Application No. 2018-547284, and English-language translation thereof.
Japanese Office Action dated Feb. 22, 2021 for corresponding Japanese Application No. 2018-546509, and English-language translation thereof.
Japanese Decision to Grant dated Mar. 18, 2021 for corresponding Japanese Application No. 2018-548129, and English-language translation thereof.
Russian Decision to Grant dated Mar. 15, 2021 for corresponding Russian Application No. 2018135744, and English-language translation thereof.
Chinese Notice of Allowance dated Mar. 15, 2021 for corresponding Chinese Application No. 201780011432.4, and English-language translation thereof.
Korean Office Action dated Nov. 1, 2021 for corresponding Korean Application No. 10-2018-7023893 and English-language translation thereof.
European Summons to attend Oral Proceedings for corresponding European Patent No. 3426074, dated Dec. 16, 2021.
Japanese Decision to Grant for corresponding Application No. 2018-548067, dated Dec. 15, 2021 and English-language translation thereof.
Chinese Office Action for corresponding Application No. 201780010772.5, dated Dec. 2, 2021 and English-language translation thereof.
Japanese Decision to Grant for corresponding Application No. 2018-546509, dated Dec. 22, 2021 and English-Language translation thereof.
Japanese Decision to Grant for corresponding Application No. 2018-546494, dated Jan. 4, 2022, and English-Language translation thereof.
Japanese Office Action dated Mar. 11, 2021 for corresponding Japanese Application No. 2018-548067, and English-language translation thereof.
Japanese Office Action dated Apr. 12, 2021 for corresponding Japanese Application No. P2018-548009, and English-language translation thereof.
Japanese Office Action dated Apr. 1, 2021 for corresponding Japanese Application No. P2018-546494, and English-language translation thereof.
Israeli Office Action dated May 3, 2021 for corresponding Israeli Application No. 260761, and English-language translation thereof.
Korean Notice of Allowance for corresponding Application No. 10-2018-7025593 dated Nov. 24, 2022, and English translation thereof.
U.S. Notice of Allowance for U.S. Appl. No. 16/577,319, dated Dec. 15, 2022.
Korean Notice of Allowance for corresponding Application No. 10-2018-7027377, dated Nov. 24, 2022, and English translation thereof.
European Brief Communication—Letter from the Opponent for corresponding Application No. 17710242.3, dated Feb. 8, 2022.
Korean Notice of Allowance for corresponding Application No. 10-2018-7023463, dated Feb. 23, 2022, with English translation included.
Korean Notice of Allowance for corresponding Application No. 10-2018-7023334, dated Mar. 25, 2022, with English translation included.
Korean Notice of Allowance for corresponding Application No. 10-2018-7023797, dated Feb. 23, 2022, with English translation included.
Korean Office Action for corresponding Application No. 10-2018-7027377, dated May 27, 2022, with English Translation included.
Korean Notice of Allowance for corresponding Application No. 10-2018-7023893, dated May 25, 2022, with English translation included.
Korean Office Action for corresponding Application No. 10-2018-7025593, dated May 24, 2022, with English Translation.
U.S. Notice of Allowance for corresponding U.S. Appl. No. 16/445,775, dated Mar. 10, 2022.
European Opposition Division Decision for corresponding Application No. 17710242.3, dated Dec. 8, 2022.
European Letter from the Opponent for corresponding Application No. 17710242.3, dated May 19, 2022.
European Letter from the Opponent for corresponding Application No. 17710242.3, dated Jun. 29, 2022.
Cambridge Dictionary—"Definition of alternate—to happen or exist one after the other repeatedly" (<https://dictionary.cambridge.org/dictionary/english/alternate>), retrieved on Jul. 15, 2021.
Dictionary.com—"Definition of alternate—to interchange repeatedly and regularly with one another in time or place" (<https://www.dictionary.com/browse/alternate>), retrieved on Jul. 14, 2021.
Macmillan Dictionary—"Definition of alternate—happening or coming one after another, in a regular pattern" (<https://www.macmillandictionary.com/dictionary/british/alternate_2>), retrieved Jul. 15, 2021.
Merriam-Webster—"Definition of alternate" (<https://www.merriam-webster.com/dictionary/alternate>), retrieved May 12, 2022.
Dictionary.com—"Definition of alternate" (<https://www.dictionary.com/browse/alternate>), retrieved May 12, 2022.
"Definition of common", in: Merriam-Webster, (<https://www.merriamwebster.com/dictionary/common>), retrieved on Jun. 24, 2022.
Feature analyses of the independent claims of Auxiliary Requests 1-4, dated May 12, 2022.
Korean Notice of Allowance for corresponding Application No. 10-2018-7025729, dated May 27, 2022.
Brazilian Office Action for corresponding Application No. 1120180172391, dated Apr. 29, 2022, with English Translation.
U.S. Office Action dated Aug. 22, 2022, for corresponding U.S. Appl. No. 16/577,319.
Filipino Office Action for corresponding Application No. 1/2018/501784, dated Mar. 5, 2023.
U.S. Office Action dated Mar. 27, 2023, for U.S. Appl. No. 17/019,915.
Japanese Decision to Grant for corresponding Application No. 2022-014331, dated Mar. 6, 2023, and English-Language translation thereof.
Canadian Office Action for corresponding Application No. 3,009,955, dated Apr. 3, 2023.
Japanese Notice of Allowance dated Oct. 4, 2021 for corresponding Japanese Application No. 2018-541284, and English-language translation thereof.
Chinese Office Action dated Aug. 26, 2021 for corresponding Chinese Application No. 201780011672.4, and English-language translation thereof.
Chinese Office Action dated Jul. 6, 2021 for corresponding Chinese Application No. 201780010768.9, and English-language translation thereof.
Japanese Office Action dated Aug. 23, 2021 for corresponding Japanese Application No. 2018-548067, and English-language translation thereof.
Chinese Office Action dated May 14, 2021 for corresponding Chinese Application No. 201780016476.6, and English-language translation thereof.
Japanese Office Action dated Apr. 1, 2021 for corresponding Japanese Application No. 2018-541284, and English-language translation thereof.
Chinese Office Action dated Jun. 3, 2021 for corresponding Chinese Application No. 201780012415.2, and English-language translation thereof.

(56) References Cited

OTHER PUBLICATIONS

Korean Office Action dated Aug. 17, 2021 for corresponding Korean Application No. 10-2018-7023797, and English-language translation thereof.
Chinese Office Action dated Jun. 30, 2021 for corresponding Chinese Application No. 201780010772.5, and English-language translation thereof.
Chinese Office Action dated Jun. 3, 2021 for corresponding Chinese Application No. 201780013171.X, and English-language translation thereof.
Korean Office Action dated Aug. 12, 2021 for corresponding Korean Application No. 10-2018-7023334, and English-language translation thereof.
U.S. Office Action dated Nov. 22, 2021 for corresponding U.S. Appl. No. 16/558,999.
U.S. Office Action dated Nov. 24, 2021 for corresponding U.S. Appl. No. 16/445,775.
Korean Office Action dated Nov. 10, 2021 for corresponding Korean Application No. 10-2018-7025729, and English-language translation thereof.
Japanese Office Action dated Nov. 1, 2021 for corresponding Japanese Application No. 2018-548009, and English-language translation thereof.
Korean Notice of Allowance dated Nov. 4, 2021 for corresponding Korean Application No. 10-2018-7027377, and English-language translation thereof.
Japanese Notice of Allowance dated Nov. 29, 2021 for corresponding Japanese Application No. 2018-548009, and English-language translation thereof.
Korean Office Action dated Nov. 10, 2021 for corresponding Korean Application No. 2018-7025593, and English-language translation thereof.
Malaysian Office Action for Application No. PI2018702870, dated May 24, 2023, with English Translation.
Canadian Office Action for Application No. 3009118, dated Jun. 28, 2023.
Chinese Office Action for Application No. 201780013171.X, dated Jun. 19, 2023, with English Translation included.
Russian Office Action and Search Report dated Aug. 23, 2023 for corresponding Russian Applicantion No. 2020115739, and English-language translation thereof.
Office Action dated Oct. 16, 2023 issued in related U.S. Appl. No. 17/019,915.
Office Action dated Sep. 21, 2023 issued in related Mexican patent application No. MX/A/18/010382.
Notice of Allowance dated Dec. 19, 2023 issued in related U.S. Appl. No. 16/577,319.
Notice of Allowance dated Dec. 12, 2023 issued in related U.S. Appl. No. 16/449,897.
Notice of Allowance dated Dec. 12, 2023 issued in related U.S. Appl. No. 16/558,999.
Notice of Allowance dated Dec. 12, 2023 issued in related U.S. Appl. No. 16/227,354.
Notice of Allowance dated Jan. 3, 2024 issued in related U.S. Appl. No. 16/445,775.
Office Action dated Dec. 22, 2023 issued in Chinese patent application No. 201780016476.6.
Decision to Grant dated Jan. 17, 2024 issued in Russian patent application No. 2020115739.
Letter from the Opponent dated Dec. 21, 2023 issued in corresponding European patent No. 3426074.
Notice of Allowance dated Jan. 29, 2024 issued in corresponding U.S. Appl. No. 16/227,354.
Notice of Allowance dated Feb. 9, 2024 issued in corresponding U.S. Appl. No. 16/558,999.
Notice of Allowance dated Jan. 29, 2024 issued in corresponding U.S. Appl. No. 16/449,897.
Office Action dated Feb. 2, 2024 issued in corresponding U.S. Appl. No. 17/019,915.
Office Action dated Feb. 9, 2024 issued in corresponding U.S. Appl. No. 17/019,915.
Notice of Allowance dated Feb. 9, 2024 issued in corresponding U.S. Appl. No. 16/445,775.
Office Action dated Jan. 19, 2024 issued in corresponding Chinese Patent Application No. 2017800131171.X.
Office Action dated Apr. 7, 2024 issued in Chinese patent application No. 201780012415.2.
Notice of Allowance dated May 24, 2024 issued in Phillippines Patent Application No. 1-2018-501784.
Office Action dated Apr. 23, 2024 issued in Chinese Patent Application No. 201780016476.6.
Notice of Allowance dated Jul. 9, 2024 issued in U.S. Appl. No. 16/558,999.
Office Action dated Jul. 3, 2024 issued in U.S. Appl. No. 18/354,826.
Office Action dated Jul. 9, 2024 issued in U.S. Appl. No. 17/019,915.
Office Action dated Jul. 5, 2024 issued in U.S. Appl. No. 18/354,100.
Notice of Allowance dated Jul. 22, 2024 issued in U.S. Appl. No. 15/067,990.
Notice of Allowance dated Aug. 15, 2024 issued in U.S. Appl. No. 16/558,999.
Notice of Allowance dated Aug. 28, 2024 issued in U.S. Appl. No. 16/577,319.
Notice of Allowance dated Sep. 3, 2024 issued in U.S. Appl. No. 16/445,775.
Notice of Allowance dated Sep. 18, 2024 issued in U.S. Appl. No. 15/067,990.
Board Decision dated Sep. 19, 2024 issued in Chinese Patent Application No. 201780012415.2.
Notice of Allowance dated Sep. 25, 2024 issued in U.S. Appl. No. 16/227,354.
Notice of Allowance dated Sep. 25, 2024 issued in U.S. Appl. No. 16/449,897.

* cited by examiner

COMBINED CARTRIDGE FOR ELECTRONIC VAPING DEVICE

CROSS-REFERENCE TO RELATED APPLICATIONS

This application is a continuation application of U.S. application Ser. No. 16/227,354, filed on Dec. 20, 2018, which is a continuation application of U.S. application Ser. No. 15/063,900, filed on Mar. 8, 2016, the entire contents of each of which are hereby incorporated by reference.

BACKGROUND

Field

Example embodiments relate to electronic vaping or e-vaping devices.

Description of Related Art

E-vaping devices, also referred to herein as electronic vaping devices (EVDs) may be used by adult vapers for portable vaping. An e-vaping device may vaporize a pre-vapor formulation to form a vapor. The e-vaping device may include a reservoir that holds a pre-vapor formulation and a heater that vaporizes the pre-vapor formulation.

In some cases, an e-vaping device may include multiple pre-vapor formulations. However, in some cases the separate pre-vapor formulations may react with each other when held in a reservoir of an e-vaping device. Such reactions may result in the degradation of one or more of the pre-vapor formulations, formation of one or more reaction products, thereby reducing a shelf-life of a portion of the e-vaping device.

In some cases, an individual pre-vapor formulation may include multiple elements that may react with each other, resulting in a degradation of the individual pre-vapor formulation and thereby reducing a shelf-life of a portion of an e-vaping device holding the individual pre-vapor formulation.

SUMMARY

According to some example embodiments, a cartridge for an e-vaping device may include a housing, a plurality of reservoirs positioned within the housing, a dispensing interface coupled to the plurality of reservoirs, and a heater coupled to the dispensing interface. The plurality of reservoirs may be configured to hold different pre-vapor formulations. The dispensing interface may be configured to draw the different pre-vapor formulations from the plurality of reservoirs. The heater may be configured to simultaneously vaporize the different pre-vapor formulations to form a vapor.

In some example embodiments, the dispensing interface may include a trunk and a plurality of separate roots, the separate roots extending from the trunk into separate, respective reservoirs of the plurality of reservoirs. The heater may be coupled to the trunk.

In some example embodiments, the trunk may include separate portions coupled to separate roots such that the portions are configured to hold different pre-vapor formulations drawn from separate roots. The heater may be configured to heat the separate portions of the trunk at different rates simultaneously.

In some example embodiments, the heater may include a plurality of heating elements, each separate heating element being coupled to a separate portion of the trunk, each separate heating element being configured to generate a different magnitude of heat.

In some example embodiments, the cartridge may include a constrictor coupled to at least one root of the dispensing interface. The constrictor may be configured to adjustably control a rate of transport at which the at least one root draws at least one pre-vapor formulation based on adjustably constricting at least a portion of the at least one root.

In some example embodiments, the separate roots may include different porosities.

In some example embodiments, the different pre-vapor formulations may include different viscosities at a common temperature.

In some example embodiments, the dispensing interface may be configured to simultaneously draw the different pre-vapor formulations to the trunk at a common rate of transport.

In some example embodiments, the dispensing interface may include a plurality of wicks coupled together to form the trunk, and separate wicks of the plurality of wicks include separate roots of the plurality of separate roots.

In some example embodiments, the separate wicks may include different wicking materials.

In some example embodiments, the cartridge may include a divider assembly partitioning at least two separate wicks of the plurality of wicks. The divider assembly may be configured to mitigate pre-vaporization mixing of separate pre-vapor formulations drawn to the trunk via the at least two separate wicks.

In some example embodiments, the housing may include first and second ends; and the trunk may be positioned proximate to the first end.

According to some example embodiments, an e-vaping device may include a cartridge and a power supply section. The cartridge may include a housing, a plurality of reservoirs positioned within the housing, a dispensing interface coupled to the plurality of reservoirs, and a heater coupled to the dispensing interface. The plurality of reservoirs may be configured to hold different pre-vapor formulations. The dispensing interface may be configured to draw the different pre-vapor formulations from the plurality of reservoirs. The heater may be operable to simultaneously vaporize the different pre-vapor formulations to form a vapor. The power supply section may be configured to selectively supply power to the heater.

In some example embodiments, the dispensing interface may be configured to simultaneously draw the different pre-vapor formulations at a common rate of transport.

In some example embodiments, the dispensing interface may be configured to draw at least one pre-vapor formulation at an adjustable rate of transport.

In some example embodiments, the dispensing interface includes a trunk and a plurality of separate roots, the separate roots extending from the trunk into separate, respective reservoirs of the plurality of reservoirs; and the heater may be coupled to the trunk.

In some example embodiments, the dispensing interface may include a plurality of wicks coupled together, the plurality of wicks including separate roots of the plurality of separate roots.

In some example embodiments, the housing may include first and second ends, the first end is distal from the housing opening, and the second end may be proximate to the housing opening. The dispensing interface may be positioned proximate to the first end of the housing.

In some example embodiments, the power supply section may include a rechargeable battery, the power supply section being removably coupled to the cartridge.

According to some example embodiments, a method includes configuring a cartridge to vaporize different pre-vapor formulations simultaneously within a housing of the cartridge, the cartridge being for use in an e-vaping device. The configuring may include coupling a dispensing interface to a plurality of reservoirs within the housing, the plurality of reservoirs configured to hold different pre-vapor formulations, the dispensing interface configured to draw the different pre-vapor formulations from the plurality of reservoirs. The coupling may include coupling a heater to the dispensing interface, such the heater is operable to simultaneously vaporize the different pre-vapor formulations drawn from the plurality of reservoirs.

In some example embodiments, the different pre-vapor formulations include different viscosities at a common temperature.

In some example embodiments, the dispensing interface may include a trunk and a plurality of separate roots, the separate roots extending from the trunk into separate, respective reservoirs of the plurality of reservoirs. Coupling the heater to the dispensing interface may include coupling the heater to the trunk.

In some example embodiments, the method may include fabricating the dispensing interface prior to coupling the dispensing interface to the plurality of reservoirs, the fabricating including coupling a plurality of separate wicks together to establish the trunk.

In some example embodiments, coupling the plurality of separate wicks together to establish the trunk may include inserting a heater divider assembly between at least two separate wicks of the plurality of separate wicks to configure the dispensing interface to mitigate pre-vaporization mixing of separate pre-vapor formulations.

BRIEF DESCRIPTION OF THE DRAWINGS

The various features and advantages of the non-limiting embodiments herein become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION OF EXAMPLE EMBODIMENTS

Figure 1A:
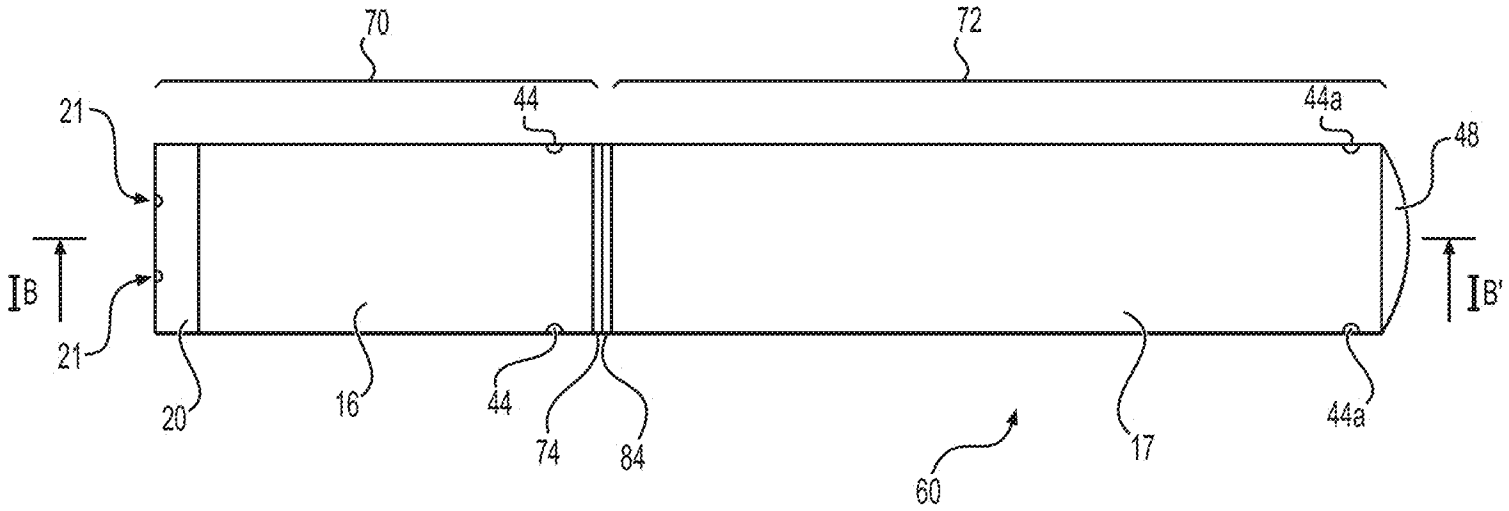
FIG. 1A is a side view of an e-vaping device according to some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising,"

when used in this specification, specify the presence of stated features, integers, steps, operations, and/or elements, but do not preclude the presence or addition of one or more other features, integers, steps, operations, elements, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Figure 1B:
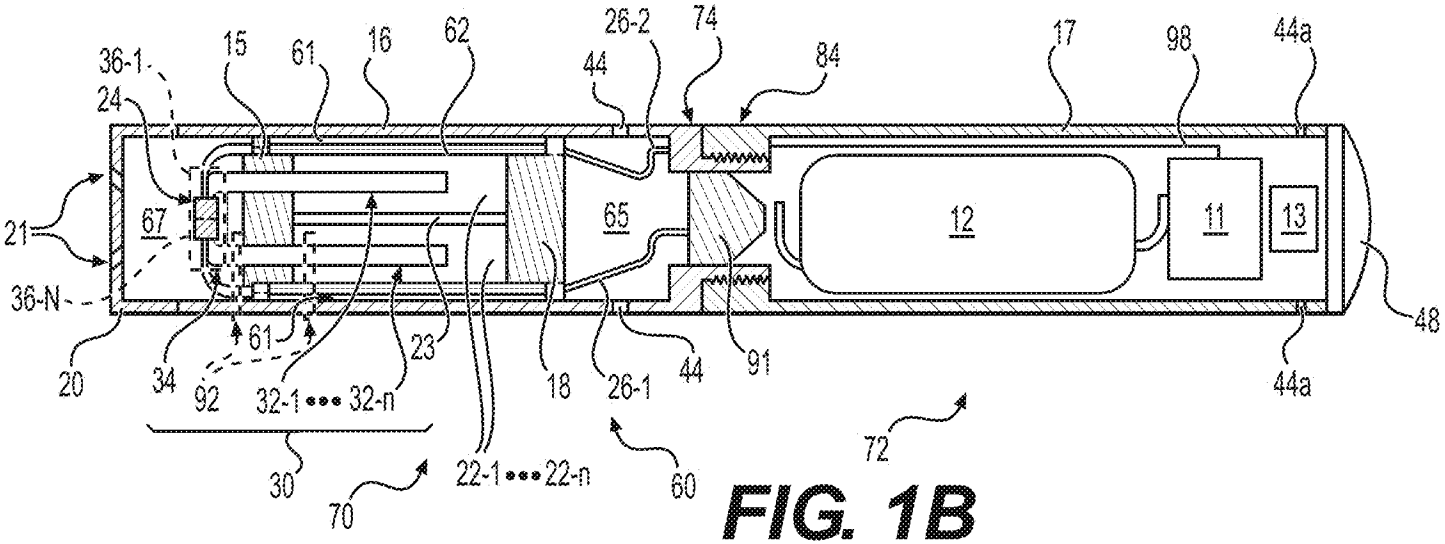
FIG. 1B is a cross-sectional view along line IB-IB' of the e-vaping device of FIG. 1A.
Figure 1C:
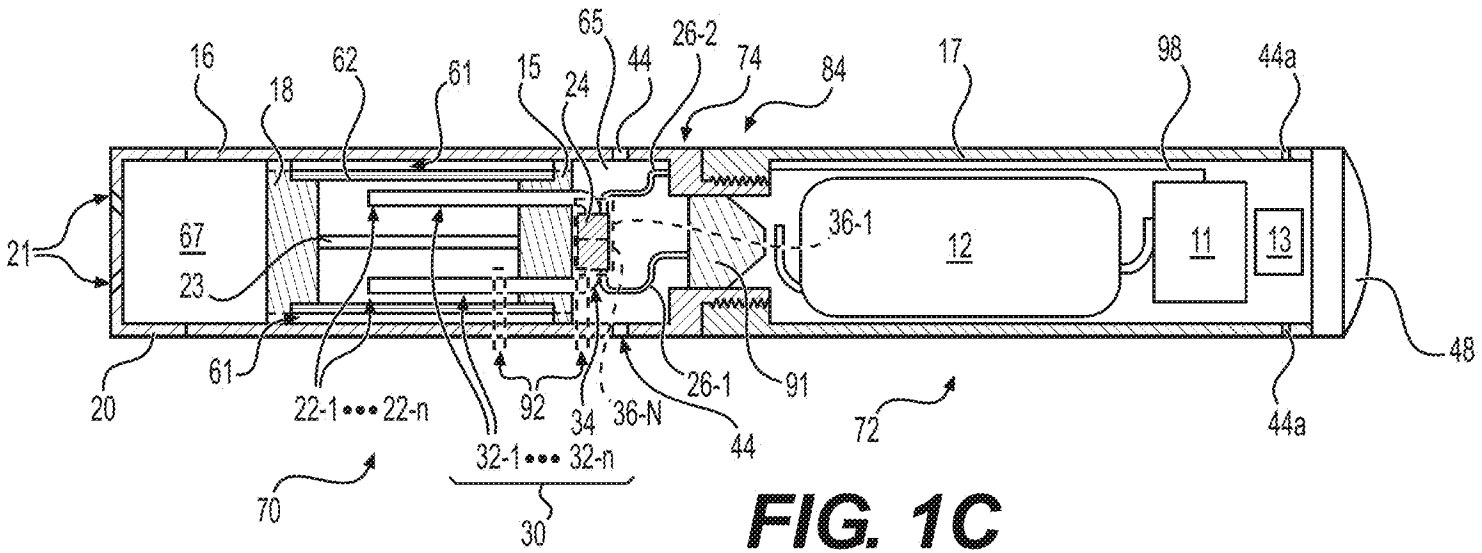
FIG. 1C is a cross-sectional view along line IB-IB' of the e-vaping device of FIG. 1A.

FIG. 1A is a side view of an e-vaping device 60 according to some example embodiments. FIG. 1B is a cross-sectional view along line IB-IB' of the e-vaping device of FIG. 1A according to some example embodiments. FIG. 1C is a cross-sectional view along line IB-IB' of the e-vaping device of FIG. 1A according to some example embodiments. The e-vaping device 60 may include one or more of the features set forth in U.S. Patent Application Publication No. 2013/0192623 to Tucker et al. filed Jan. 31, 2013 and U.S. Patent Application Publication No. 2013/0192619 to Tucker et al. filed Jan. 14, 2013, the entire contents of which are incorporated herein by reference thereto. As used herein, the term "e-vaping device" is inclusive of all types of electronic vaping devices, regardless of form, size and/or shape.

Referring to FIG. 1A, FIG. 1B, and FIG. 1C, an e-vaping device 60 includes a replaceable cartridge (or first section) 70 and a reusable power supply section (or second section) 72. The first and second sections 70, 72 may be removably coupled together at complimentary interfaces 74, 84 of the respective sections 70, 72.

In some example embodiments, the interfaces 74, 84 are threaded connectors. However, it should be appreciated that each interface 74, 84 may be any type of connector, including a snug-fit, detent, clamp, bayonet, and/or clasp. One or more of the interfaces 74, 84 may include a cathode connector, anode connector, some combination thereof, etc. to electrically couple one or more elements of the cartridge 70 to one or more power supplies 12 in the power supply section 72 when the interfaces 74, 84 are coupled together.

As shown in FIG. 1A, FIG. 1B, and FIG. 1C, in some example embodiments, an outlet end insert 20 is positioned at an outlet end of the cartridge 70. The outlet end insert 20 includes at least one outlet port 21 that may be located off-axis from the longitudinal axis of the e-vaping device 60. One or more of the outlet ports 21 may be angled outwardly in relation to the longitudinal axis of the e-vaping device 60. Multiple outlet ports 21 may be uniformly or substantially uniformly distributed about the perimeter of the outlet end insert 20 so as to substantially uniformly distribute vapor drawn through the outlet end insert 20 during vaping. Thus, as a vapor is drawn through the outlet end insert 20, the vapor may move in different directions.

The cartridge 70 includes an outer housing 16 extending in a longitudinal direction and an inner tube 62 coaxially positioned within the outer housing 16. The power supply section 72 includes an outer housing 17 extending in a longitudinal direction. In some example embodiments, the outer housing 16 may be a single tube housing both the cartridge 70 and the power supply section 72 and the entire e-vaping device 60 may be disposable. The outer housings 16, 17 may each have a generally cylindrical cross-section. In some example embodiments, the outer housings 16, 17 may each have a generally triangular cross-section along one or more of the cartridge 70 and the power supply section 72. In some example embodiments, the outer housing 17 may have a greater circumference or dimensions at a tip end than a circumference or dimensions of the outer housing 16 at an outlet end of the e-vaping device 60.

At one end of the inner tube 62, a nose portion of a gasket (or seal) 18 is fitted into an end portion of the inner tube 62. An outer perimeter of the gasket 18 provides at least a partial seal with an interior surface of the outer housing 16. In some example embodiments, the gasket 18 includes conduits extending through the gasket 18 between the housing 16 and the inner tube 62. The exterior of the inner tube 62 and the outer housing 16 at least partially define an annular channel 61. One or more conduits through an annular portion of the gasket 18 may assure communication between the annular channel 61 and a space 65 defined between the gasket 18 and a connector element 91. The connector element 91 may be included in the interface 74.

In some example embodiments, a nose portion of another gasket 15 is fitted into another end portion of the inner tube 62. In some example embodiments, the gasket 15 includes conduits extending through the gasket 15 between the housing 16 and the inner tube 62. One or more conduits through an annular portion of the gasket 15 may assure communication between the annular channel 61 and an interior 67 of the outlet end insert 20.

In some example embodiments, at least one air inlet port 44 is formed in the outer housing 16, adjacent to the interface 74 to minimize the chance of an adult vaper's fingers occluding one of the ports and to control the resistance-to-draw (RTD) during vaping. In some example embodiments, the air inlet ports 44 may be machined into the outer housing 16 with precision tooling such that their diameters are closely controlled and replicated from one e-vaping device 60 to the next during manufacture.

In a further example embodiment, the air inlet ports 44 may be drilled with carbide drill bits or other high-precision tools and/or techniques. In yet a further example embodiment, the outer housing 16 may be formed of metal or metal alloys such that the size and shape of the air inlet ports 44 may not be altered during manufacturing operations, packaging, and vaping. Thus, the air inlet ports 44 may provide consistent RTD. In yet a further example embodiment, the air inlet ports 44 may be sized and configured such that the e-vaping device 60 has a RTD in the range of from about 60 mm $H_2O$ to about 150 mm $H_2O$.

Referring to FIG. 1A, FIG. 1B, and FIG. 1C, the cartridge 70 includes a set of separate reservoirs 22-1 to 22-N. "N" may be an integer equal to 2 or greater. The space defined between the gaskets 18 and 15 and the inner tube 62 may establish the confines of the reservoirs 22-1 to 22-N. The space may be partitioned by one or more dividers 23 into multiple separate reservoirs 22-1 to 22-N. The separate reservoirs 22-1 to 22-N may be separate and unconnected reservoirs 22-1 to 22-N.

In some example embodiments, the separate reservoirs 22-1 to 22-N are configured to hold separate pre-vapor formulations. The separate pre-vapor formulations may be different pre-vapor formulations. For example, the separate reservoirs 22-1 to 22-N may include different sets of storage media, where the different sets of storage media are configured to hold different pre-vapor formulations.

The cartridge 70 includes a dispensing interface 30 coupled to the separate reservoirs 22-1 to 22-N. The dispensing interface 30 is configured to draw separate pre-vapor formulations from the separate reservoirs 22-1 to 22-N.

In some example embodiments, the dispensing interface 30 may include a trunk and multiple roots extending from the trunk. The roots may be separately coupled to separate reservoirs 22-1 to 22-N, such that the separate roots extend into the separate reservoirs. For example, as shown in FIG. 1B and FIG. 1C, the dispensing interface 30 includes a trunk 34 and separate roots 32-1 to 32-N extending from the trunk 34 into separate reservoirs 22-1 to 22-N. The dispensing interface 30 may draw the pre-vapor formulations from the separate reservoirs 22-1 to 22-N into the trunk 34 via the separate roots 32-1 to 32-N.

In some example embodiments, dispensing interface 30 includes at least one of a ceramic material extending into one or more reservoirs 22-1 to 22-N, a dispensing interface that includes a porous material extending into one or more reservoirs 22-1 to 22-N, some combination thereof, etc.

The cartridge 70 includes a heater 24 that is coupled to the dispensing interface 30. The heater 24 may heat the separate pre-vapor formulations drawn by the dispensing interface 30 to simultaneously vaporize the separate pre-vapor formulations. As shown in the example embodiments illustrated in FIG. 1B and FIG. 1C, the heater 24 may be coupled to the dispensing interface 30 at the trunk 34 and may simultaneously vaporize the different pre-vapor formulations drawn to the trunk 34 via the roots 32-1 to 32-N, thereby forming a combined vapor from the different pre-vapor formulations.

In the example embodiment illustrated in FIG. 1B, the heater 24 extends transversely across the interior 67 of the outlet end insert 20. In the example embodiment illustrated in FIG. 1C, the heater 24 extends transversely across the space 65. In some example embodiments, the heater 24 may extend parallel to a longitudinal axis of the annular channel 61.

In some example embodiments, the dispensing interface 30 includes an absorbent material. The absorbent material may be arranged in fluidic communication with the heater 24. The absorbent material may include a wick having an elongated form and arranged in fluidic communication with at least one reservoir of the plurality of reservoirs.

In some example embodiments, the dispensing interface 30 includes a porous material. For example, the dispensing interface 30 may include at least one ceramic rod configured to direct pre-vapor formulation from at least one of the reservoirs 22-1 to 22-N through an interior of the at least one ceramic rod. In another example, the dispensing interface 30 may include at least one wick material, that is configured to direct pre-vapor formulation through an interior of the at least one wick material. A wick material may be a flexible wick material.

In some example embodiments, the dispensing interface 30 includes a nonporous material. For example, the dispensing interface 30 may include at a channel apparatus that includes a conduit, where the channel apparatus is configured to direct a pre-vapor formulation from a reservoir 22-1 to 22-N through the conduit. In another example, the dispensing interface 30 may include a drip action apparatus. In another example, the dispensing interface 30 may include a valve configured to direct pre-vapor formulation from at least one of the reservoirs 22-1 to 22-N based on actuation of the valve.

In some example embodiments, the dispensing interface 30 is configured to draw different pre-vapor formulations from the separate reservoirs 22-1 to 22-N to a common location where the pre-vapor formulations may be simultaneously vaporized by a heater 24. The dispensing interface 30 may include multiple roots 32-1 to 32-N extending from a common trunk 34 into separate reservoirs 22-1 to 22-N. Each root 32-1 to 32-N may draw a different pre-vapor formulation from a separate reservoir to the trunk 34.

During vaping, different pre-vapor formulations held in the separate reservoirs 22-1 to 22-N may be transferred from the reservoirs 22-1 to 22-N and/or storage medium to the trunk 34 via capillary action of the separate roots 32-1 to 32-N extending into the separate reservoirs 22-1 to 22-N. The heater 24 may at least partially surround a portion of the trunk 34 such that when the heater 24 is activated, the different pre-vapor formulations drawn to the trunk 34 from the separate reservoirs 22-1 to 22-N are simultaneously vaporized by the heater 24 to form a combined vapor. In some example embodiments, including the example embodiments illustrated in FIG. 1B and FIG. 1C, the heater 24 completely surrounds the trunk 34.

Such a combined vapor, formed via simultaneous vaporization of different pre-vapor formulations at the trunk 34, may provide a combined vapor, where the combined vapor includes different vaporized pre-vapor formulations without mixing the pre-vapor formulations prior to forming the vapor. Therefore, a probability of chemical reactions between the pre-vapor formulations prior to forming the vapor may be mitigated. Mitigation of a probability of such chemical reactions may enhance a sensory experience provided by the e-vaping device to an adult vaper during vaping. Mitigation of a probability of such chemical reactions may increase one or more of stability of one or more pre-vapor formulations and shelf life of the one or more pre-vapor formulations.

In some example embodiments, the dispensing interface 30 is configured to draw different pre-vapor formulations from the separate reservoirs 22-1 to 22-N to the trunk 34 at a common rate of transport, such that the different pre-vapor formulations drawn from the reservoirs 22-1 to 22-N arrive at a common location in the dispensing interface 30 simultaneously. In some example embodiments, the dispensing interface 30 is configured to draw different pre-vapor formulations from the separate reservoirs 22-1 to 22-N to the trunk 34 at different respective rates of transport.

In some example embodiments, the separate roots 32-1 to 32-N have different properties that enable the separate roots 32-1 to 32-N to be configured to draw different pre-vapor formulations at a common rate of transport, where the different pre-vapor formulations have different properties. For example, the separate roots 32-1 to 32-N may have different porosities, so that the separate roots 32-1 to 32-N are configured to transport different pre-vapor formulations having different viscosities at a common rate of transport. In some example embodiments, the separate roots 32-1 to 32-N are configured to draw different pre-vapor formulations at different respective rates of transport. In another example, the separate roots 32-1 to 32-N may include separate wicking materials. The separate wicking materials may be different wicking materials.

In some example embodiments, a dispensing interface 30 includes a constrictor 92 coupled to at least one of the roots 32-1 to 32-N, where the constrictor 92 is configured to controllably adjust the rate of transport at which the at least one of the roots 32-1 to 32-N draws one or more pre-vapor formulations. The constrictor 92 may be configured to controllably adjust the rate of transport at which the at least one of the roots 32-1 to 32-N draws one or more pre-vapor formulations based on adjustably constricting the at least one of the roots 32-1 to 32-N. In some example embodiments, the constrictor 92 may controllably adjust the rate of transport at which the at least one of the roots 32-1 to 32-N draws one or more pre-vapor formulations based on adjusting a porosity of at least one of the roots 32-1 to 32-N. Adjusting the porosity of a root may include adjusting a diameter of the root. For example, the constrictor 92 may adjustably constrict a diameter of at least one of the roots 32-1 to 32-N to adjustably control a rate at which the at least one of the roots 32-1 to 32-N transports one or more pre-vapor formulations. The constrictor 92 may be configured to be controllably adjusted by one or more of an adult vaper, control circuitry 11, some combination thereof, or the like.

For example, in the example embodiments illustrated in FIG. 1B and FIG. 1C, one or more constrictors 92 extend from root 32-N to an exterior of the outer housing 16, such that the constrictor 92 is configured to be controlled by an adult vaper to adjustably control the constriction of the root 32-N. In some example embodiments, an e-vaping device 60 may include a constrictor 92 coupled with a root 32-N within a reservoir 22-N, in one of the space 65 and interior 67 outside of the reservoir 22-N, or some combination thereof. Adjustable control of the rate of transport at which at least one of the roots 32-1 to 32-N draws a pre-vapor formulation enables control of one or more of flavor intensity of a vapor provided by the e-vaping device 60, a quality of the vapor provided by the e-vaping device 60, some combination thereof, etc.

In some example embodiments, as discussed further below, the dispensing interface 30 includes multiple separate wicks, where the wicks are coupled together to form the trunk 34 and the separate wicks extend from the trunk 34 into separate reservoirs 22-1 to 22-N as separate roots 32-1 to 32-N. Separate wicks may include separate materials, such that the separate wicks are configured to draw different pre-vapor formulations at a common rate of transport to the trunk 34. In some example embodiments, the separate wicks are configured to draw different pre-vapor formulations at different respective rates of transport to the trunk 34.

In some example embodiments, the cartridge 70 includes first and second ends. The first and second ends may be opposite ends of the cartridge 70. The dispensing interface 30 may be coupled to the separate reservoirs proximate to a particular end of first and second ends, such that the dispensing interface 30 is positioned proximate to the particular end. The dispensing interface 30 may draw different pre-vapor formulations from the different reservoirs 22-1 to 22-N towards the particular end. The heater 24 may vaporize the different pre-vapor formulations at a location that is closer to the particular end of the cartridge 70 than an opposite end of the first section. As described further below, the first and second ends of the first section are referred to as an outlet end proximate to the outlet end insert 20 and a tip end proximate to the interface 74. However, it will be understood that the first and second ends may refer to any set of opposite ends in any order or arrangement.

For example, as shown in FIG. 1B, the dispensing interface 30 may be coupled to the reservoirs 22-1 to 22-N at respective ends of the reservoirs 22-1 to 22-N proximate to the outlet end (first end) of the cartridge 70. The dispensing interface 30 extends from the reservoirs 22-1 to 22-N into the interior 67 of the outlet end insert, and the heater 24 is coupled to the trunk 34 in the interior 67. Electrical leads 26-1, 26-2 extend between the heater 24 and respective ones of the connector element 91 and interface 74 to electrically couple the heater 24 to the power supply 12 when interfaces 74, 84 are coupled together. Air entering the cartridge 70 through air inlet ports 44 may pass to the interior 67 via the annular channel 61. Air entering the interior 67 from the channel 61 may draw vapors formed at the trunk 34 to the outlet ports 21 of the outlet end insert.

In another example, as shown in FIG. 1C, the dispensing interface 30 may be coupled to the reservoirs 22-1 to 22-N at respective ends of the reservoirs 22-1 to 22-N proximate to the tip end (second end) of the cartridge 70. The dispensing interface 30 extends from the reservoirs 22-1 to 22-N into the space 65 between the gasket 18 and the connector element 91, and the heater 24 is coupled to the trunk 34 in the space 65. Electrical leads 26-1, 26-2 extend between the heater 24 and respective ones of the connector element 91 and the interface 74 through the space 65 to electrically couple the heater 24 to the power supply 12 when interfaces 74, 84 are coupled together. Air entering the cartridge 70 through air inlet ports 44 may draw vapors formed at the trunk 34 to the outlet ports 21 of the outlet end insert via the channel 61 and the interior 67.

In some example embodiments, the vapor exiting the e-vaping device via the outlet end insert 20 may be cooler or warmer based on the end of the cartridge 70 to which the dispensing interface 30 is more closely positioned. For example, vapors formed in the space 65 proximate to the tip end of the cartridge 70, as shown in FIG. 1C, may be cooler than vapors formed in the interior 67 proximate to the outlet end of the first section, as shown in FIG. 1B. Vapors passing through the annular channel 61 to the interior may cool prior to reaching the outlet ports 21, while vapors formed in the interior 67 may not cool as much. A vapor provided to an adult vaper may provide a different sensory experience based on the temperature of the vapor. As a result, the e-vaping device 60 may provide the adult vaper with a unique sensory experience based on the configuration of the dispensing interface 30 in the cartridge 70.

Still referring to FIG. 1A, FIG. 1B, and FIG. 1C, the cartridge 70 includes a connector element 91 configured to at least partially establish electrical connections between elements in the cartridge 70 with one or more elements in the power supply section 72. In some example embodiments, the connector element 91 includes an electrode element configured to electrically couple at least one electrical lead to the power supply 12 in the power supply section when interfaces 74, 84 are coupled together. In the example embodiments illustrated in FIG. 1A, FIG. 1B, and FIG. 1C, for example, electrical lead 26-1 is coupled to connector element 91. An electrode element may be one or more of a cathode connector element and an anode connector element. If and/or when interfaces 74, 84 are coupled together, the connector element 91 may be coupled with at least one portion of the power supply 12, as shown in FIG. 1B and FIG. 1C.

In some example embodiments, one or more of the interfaces 74, 84 include one or more of a cathode connector element and an anode connector element. In the example embodiments illustrated in FIG. 1B and FIG. 1C, for example, electrical lead 26-2 is coupled to the interface 74. As further shown in FIG. 1B and FIG. 1C, the power supply section 72 includes a lead 98 that couples the control circuitry 11 to the interface 84. If and/or when interfaces 74, 84 are coupled together, the coupled interfaces 74, 84 may electrically couple leads 26-2 and 98 together.

If and/or when an element in the cartridge 70 is coupled to both leads 26-1 and 26-2, an electrical circuit through the cartridge 70 and power supply section 72 may be established. The established electrical circuit may include at least the element in the cartridge 70, control circuitry 11, and the power supply 12. The electrical circuit may include leads 26-1 and 26-2, lead 98, and interfaces 74, 84.

In the example embodiments illustrated in FIG. 1A, FIG. 1B, and FIG. 1C, heater 24 is coupled to interface 74 and connector element 91, such that the heater 24 may be electrically coupled to the power supply 12 via interface 74 and connector element 91 if and/or when interfaces 74, 84 are coupled together.

The control circuitry 11, described further below, is configured to be coupled to the power supply 12, such that the control circuitry 11 may control the supply of electrical power from the power supply 12 to one or more elements of the cartridge 70. The control circuitry 11 may control the supply of electrical power to the element based on controlling the established electrical circuit. For example, the control circuitry 11 may selectively open or close the electrical circuit, adjustably control an electrical current through the circuit, etc.

Still referring to FIG. 1A, FIG. 1B, and FIG. 1C, the power supply section 72 includes a sensor 13 responsive to air drawn into the power supply section 72 via an air inlet port 44*a* adjacent to a free end or tip end of the e-vaping device 60, a power supply 12, and control circuitry 11. The power supply 12 may include a rechargeable battery. The sensor 13 may be one or more of a pressure sensor, a microelectromechanical system (MEMS) sensor, etc.

In some example embodiments, the power supply 12 includes a battery arranged in the e-vaping device 60 such that the anode is downstream of the cathode. A connector element 91 contacts the downstream end of the battery. The heater 24 is connected to the battery by two spaced apart electrical leads 26-1, 26-2 coupled to respective ones of a connector element 91 and interface 74.

The power supply 12 may be a Lithium-ion battery or one of its variants, for example a Lithium-ion polymer battery. Alternatively, the power supply 12 may be a nickel-metal hydride battery, a nickel cadmium battery, a lithium-manganese battery, a lithium-cobalt battery or a fuel cell. The e-vaping device 60 may be usable by an adult vaper until the energy in the power supply 12 is depleted or in the case of lithium polymer battery, a minimum voltage cut-off level is achieved.

Further, the power supply 12 may be rechargeable and may include circuitry configured to allow the battery to be chargeable by an external charging device. To recharge the e-vaping device 60, a Universal Serial Bus (USB) charger or other suitable charger assembly may be used.

Upon completing the connection between the cartridge 70 and the power supply section 72, the at least one power supply 12 may be electrically connected with the heater 24 of the cartridge 70 upon actuation of the sensor 13. Air is drawn primarily into the cartridge 70 through one or more air inlet ports 44. The one or more air inlet ports 44 may be located along the outer housing 16, 17 of the first and second sections 70, 72 or at one or more of the interfaces 74, 84.

The sensor 13 may be configured to sense an air pressure drop and initiate application of voltage from the power supply 12 to the heater 24. As shown in the example embodiments illustrated in FIG. 1B and FIG. 1C, some example embodiments of the power supply section 72 include a heater activation light 48 configured to glow when the heater 24 is activated. The heater activation light 48 may include a light emitting diode (LED). Moreover, the heater activation light 48 may be arranged to be visible to an adult vaper during vaping. In addition, the heater activation light 48 may be utilized for e-vaping system diagnostics or to indicate that recharging is in progress. The heater activation light 48 may also be configured such that the adult vaper may activate and/or deactivate the heater activation light 48 for privacy. As shown in FIG. 1A, FIG. 1B, and FIG. 1C the heater activation light 48 may be located on the tip end of the e-vaping device 60. In some example embodiments, the heater activation light 48 may be located on a side portion of the outer housing 17.

In addition, the at least one air inlet port 44*a* may be located adjacent to the sensor 13, such that the sensor 13 may sense air flow indicative of vapor being drawn through the outlet end, and activate the power supply 12 and the heater activation light 48 to indicate that the heater 24 is working.

Further, the control circuitry 11 may control the supply of electrical power to the heater 24 responsive to the sensor 13. In one example embodiment, the control circuitry 11 may include a maximum, time-period limiter. In another example embodiment, the control circuitry 11 may include a manually operable switch for manually initiating vaping. The time-period of the electric current supply to the heater 24 may be pre-set (e.g., prior to controlling the supply of electrical power to the heater 24) depending on the amount of pre-vapor formulation desired to be vaporized. In some example embodiments, the control circuitry 11 may control the supply of electrical power to the heater 24 as long as the sensor 13 detects a pressure drop.

To control the supply of electrical power to a heater 24, the control circuitry 11 may execute one or more instances of computer-executable program code. The control circuitry 11 may include a processor and a memory. The memory may be a computer-readable storage medium storing computer-executable code.

The control circuitry 11 may include processing circuitry including, but not limited to, a processor, Central Processing Unit (CPU), a controller, an arithmetic logic unit (ALU), a digital signal processor, a microcomputer, a field programmable gate array (FPGA), a System-on-Chip (SoC), a programmable logic unit, a microprocessor, or any other device capable of responding to and executing instructions in a defined manner. In some example embodiments, the control circuitry 11 may be at least one of an application-specific integrated circuit (ASIC) and an ASIC chip.

The control circuitry 11 may be configured as a special purpose machine by executing computer-readable program code stored on a storage device. The program code may include program or computer-readable instructions, software elements, software modules, data files, data structures, and/or the like, capable of being implemented by one or more hardware devices, such as one or more of the control circuitry mentioned above. Examples of program code include both machine code produced by a compiler and higher level program code that is executed using an interpreter.

The control circuitry 11 may include one or more storage devices. The one or more storage devices may be tangible or non-transitory computer-readable storage media, such as random access memory (RAM), read only memory (ROM), a permanent mass storage device (such as a disk drive), solid state (e.g., NAND flash) device, and/or any other like data storage mechanism capable of storing and recording data. The one or more storage devices may be configured to store computer programs, program code, instructions, or some combination thereof, for one or more operating systems and/or for implementing the example embodiments described herein. The computer programs, program code, instructions, or some combination thereof, may also be loaded from a separate computer readable storage medium into the one or more storage devices and/or one or more computer processing devices using a drive mechanism. Such separate computer readable storage medium may include a USB flash drive, a memory stick, a Blu-ray/DVD/CD-ROM drive, a memory card, and/or other like computer readable storage media. The computer programs, program code, instructions, or some combination thereof, may be loaded into the one or more storage devices and/or the one or more computer processing devices from a remote data storage device via a network interface, rather than via a local computer readable storage medium. Additionally, the computer programs, program code, instructions, or some combination thereof, may be loaded into the one or more storage devices and/or the one or more processors from a remote computing system that is configured to transfer and/or distribute the computer programs, program code, instructions, or some combination thereof, over a network. The remote computing system may transfer and/or distribute the computer programs, program code, instructions, or some combination thereof, via a wired interface, an air interface, and/or any other like medium.

The control circuitry 11 may be a special purpose machine configured to execute the computer-executable code to control the supply of electrical power to the heater 24. Controlling the supply of electrical power to the heater 24 may be referred to herein interchangeably as activating the heater 24.

Still referring to FIG. 1A, FIG. 1B, and FIG. 1C, when the heater 24 is activated, the activated heater 24 may heat a portion of the coupled dispensing interface 30 for less than about 10 seconds. Thus, the power cycle (or maximum vaping length) may range in period from about 2 seconds to about 10 seconds (e.g., about 3 seconds to about 9 seconds, about 4 seconds to about 8 seconds or about 5 seconds to about 7 seconds). In some example embodiments, a portion of the dispensing interface 30 that is surrounded by the heater 24 is the trunk 34.

In some example embodiments, separate portions of the heater 24 may be configured to heat to different portions 36-1 to 36-N of the trunk 34 at different rates. The different portions 36-1 to 36-N of the trunk 34 may be coupled to different roots 32-1 to 32-N. The different portions 36-1 to 36-N of the trunk 34 may hold different pre-vapor formulations drawn from different reservoirs 22-1 to 22-N through the different roots 32-1 to 32-N. The heater 24 may be configured to vaporize the different pre-vapor formulations held in the different portions 36-1 to 36-N of the trunk 34 at different rates simultaneously based on applying different magnitudes of heat to the different portions 36-1 to 36-N of the trunk 34 simultaneously.

In some example embodiments, the heater 24 may be configured to vaporize the different pre-vapor formulations at a common rate simultaneously, based on applying different magnitudes of heat to the different portions 36-1 to 36-N of the trunk 34 simultaneously. For example, different pre-vapor formulations drawn to different portions 36-1 to 36-N of the trunk 34 from different roots 32-1 to 32-N may have different properties, including at least one of different heat capacities and different heats of vaporization.

In some example embodiments, including the example embodiments shown in FIG. 2D, the heater 24 includes multiple separate heating elements 25-1 to 25-N coupled to separate portions 36-1 to 36-N of the trunk 34. The separate heating elements 25-1 to 25-N may be configured to apply different magnitudes of heat to the separate portions 36-1 to 36-N of the trunk 34 simultaneously. For example, the heater 24 may include multiple separate wire coils 25-1 to 25-N coupled to separate portions 36-1 to 36-N of the trunk 34. The separate wire coils 25-1 to 25-N may have one or more of different spacings, different materials, different electrical resistances, etc. The separate wire coils 25-1 to 25-N may be configured to provide different magnitudes of heat to the different portions 36-1 to 36-N of the trunk 34.

A pre-vapor formulation, as described herein, is a material or combination of materials that may be transformed into a vapor. For example, the pre-vapor formulation may be a liquid, solid and/or gel formulation including, but not limited to, water, beads, solvents, active ingredients, ethanol, plant extracts, natural or artificial flavors, and/or pre-vapor formulations such as glycerin and propylene glycol. Different pre-vapor formulations may include different elements. Different pre-vapor formulations may have different properties. For example, different pre-vapor formulations may have different viscosities when the different pre-vapor formulations are at a common temperature. The pre-vapor formulation may include those described in U.S. Patent Application Publication No. 2015/0020823 to Lipowicz et al. filed Jul. 16, 2014 and U.S. Patent Application Publication No. 2015/0313275 to Anderson et al. filed Jan. 21, 2015, the entire contents of each of which is incorporated herein by reference thereto.

The pre-vapor formulation may include nicotine or may exclude nicotine. The pre-vapor formulation may include one or more tobacco flavors. The pre-vapor formulation may include one or more flavors that are separate from one or more tobacco flavors.

In some example embodiments, a pre-vapor formulation that includes nicotine may also include one or more acids. The one or more acids may be one or more of pyruvic acid, formic acid, oxalic acid, glycolic acid, acetic acid, isovaleric acid, valeric acid, propionic acid, octanoic acid, lactic acid, levulinic acid, sorbic acid, malic acid, tartaric acid, succinic acid, citric acid, benzoic acid, oleic acid, aconitic acid, butyric acid, cinnamic acid, decanoic acid, 3,7-dimethyl-6-octenoic acid, 1-glutamic acid, heptanoic acid, hexanoic acid, 3-hexenoic acid, trans-2-hexenoic acid, isobutyric acid, lauric acid, 2-methylbutyric acid, 2-methylvaleric acid, myristic acid, nonanoic acid, palmitic acid, 4-penenoic acid, phenylacetic acid, 3-phenylpropionic acid, hydrochloric acid, phosphoric acid, sulfuric acid and combinations thereof.

At least one of the reservoirs 22-1 to 22-N may include a pre-vapor formulation, and optionally a storage medium configured to store the pre-vapor formulation therein. The storage medium may include a winding of cotton gauze or other fibrous material about a portion of the cartridge 70.

The storage medium of one or more reservoirs 22-1 to 22-N may be a fibrous material including at least one of cotton, polyethylene, polyester, rayon and combinations thereof. The fibers may have a diameter ranging in size from about 6 microns to about 15 microns (e.g., about 8 microns to about 12 microns or about 9 microns to about 11 microns).

The storage medium may be a sintered, porous or foamed material. Also, the fibers may be sized to be irrespirable and may have a cross-section that has a Y-shape, cross shape, clover shape or any other suitable shape. In some example embodiments, one or more reservoirs 22-1 to 22-N may include a filled tank lacking any storage medium and containing only pre-vapor formulation.

At least one of the reservoirs 22-1 to 22-N may be sized and configured to hold enough pre-vapor formulation such that the e-vaping device 60 may be configured for vaping for at least about 200 seconds. The e-vaping device 60 may be configured to allow each vaping to last a maximum of about 5 seconds.

The dispensing interface 30 may include filaments (or threads) having a capacity to draw one or more pre-vapor formulations. For example, a dispensing interface 30 may be a bundle of glass (or ceramic) filaments, a bundle including a group of windings of glass filaments, etc., all of which arrangements may be capable of drawing pre-vapor formulation via capillary action by interstitial spacings between the filaments. The filaments may be generally aligned in a direction perpendicular (transverse) to the longitudinal direction of the e-vaping device 60. In some example embodiments, the wick may include one to eight filament strands, each strand comprising a plurality of glass filaments twisted together. The end portions of the dispensing interface 30 may be flexible and foldable into the confines of one or more reservoirs 22-1 to 22-N. The filaments may have a cross-section that is generally cross-shaped, clover-shaped, Y-shaped, or in any other suitable shape. In some example embodiments, the dispensing interface 30 includes multiple separate wicks coupled together. The coupled portions of the wicks may establish a trunk of a dispensing interface, and the non-coupled portions of the wicks extending away from the trunk may be one or more roots of a dispensing interface.

The dispensing interface 30 may include any suitable material or combination of materials, also referred to herein as wicking materials. Examples of suitable materials may be, but not limited to, glass, ceramic- or graphite-based materials. The dispensing interface 30 may have any suitable capillarity drawing action to accommodate pre-vapor formulations having different physical properties such as density, viscosity, surface tension and vapor pressure.

In some example embodiments, the heater 24 may include a wire coil that at least partially surrounds the trunk 34 of at least one dispensing interface. The wire may be a metal wire and/or the wire coil may extend fully or partially along the length of the trunk 34. The wire coil may further extend fully or partially around the circumference of the trunk 34. In some example embodiments, the wire coil may or may not be in contact with dispensing interface 30 to which the wire coil is coupled.

The heater 24 may be formed of any suitable electrically resistive materials. Examples of suitable electrically resistive materials may include, but not limited to, titanium, zirconium, tantalum and metals from the platinum group. Examples of suitable metal alloys include, but not limited to, stainless steel, nickel, cobalt, chromium, aluminum-titanium-zirconium, hafnium, niobium, molybdenum, tantalum, tungsten, tin, gallium, manganese and iron-containing alloys, and super-alloys based on nickel, iron, cobalt, stainless steel. For example, the heater 24 may be formed of nickel aluminide, a material with a layer of alumina on the surface, iron aluminide and other composite materials, the electrically resistive material may optionally be embedded in, encapsulated or coated with an insulating material or vice-versa, depending on the kinetics of energy transfer and the external physicochemical properties required. The heater 24 may include at least one material selected from the group including at least one of stainless steel, copper, copper alloys, nickel-chromium alloys, super alloys and combinations thereof. In some example embodiments, the heater 24 may be formed of nickel-chromium alloys or iron-chromium alloys. In some example embodiments, the heater 24 may be a ceramic heater having an electrically resistive layer on an outside surface thereof.

The heater 24 may heat one or more pre-vapor formulations in the dispensing interface 30 by thermal conduction. Alternatively, heat from the heater 24 may be conducted to the one or more pre-vapor formulations by a heat conductive element or the heater 24 may transfer heat to the incoming ambient air that is drawn through the e-vaping device 60 during vaping, which in turn heats the pre-vapor formulation by convection.

In some example embodiments, the cartridge 70 may be replaceable. In other words, once the pre-vapor formulation of the cartridge 70 is depleted, only the cartridge 70 may be replaced. An alternate arrangement may include an example embodiment where the entire e-vaping device 60 may be disposed once one or more of the reservoirs 22-1 to 22-N are depleted.

In an example embodiment, the e-vaping device 60 may be about 80 mm to about 110 mm long and about 7 mm to about 8 mm in diameter. For example, in one example embodiment, the e-vaping device may be about 84 mm long and may have a diameter of about 7.8 mm.

Figure 2A:
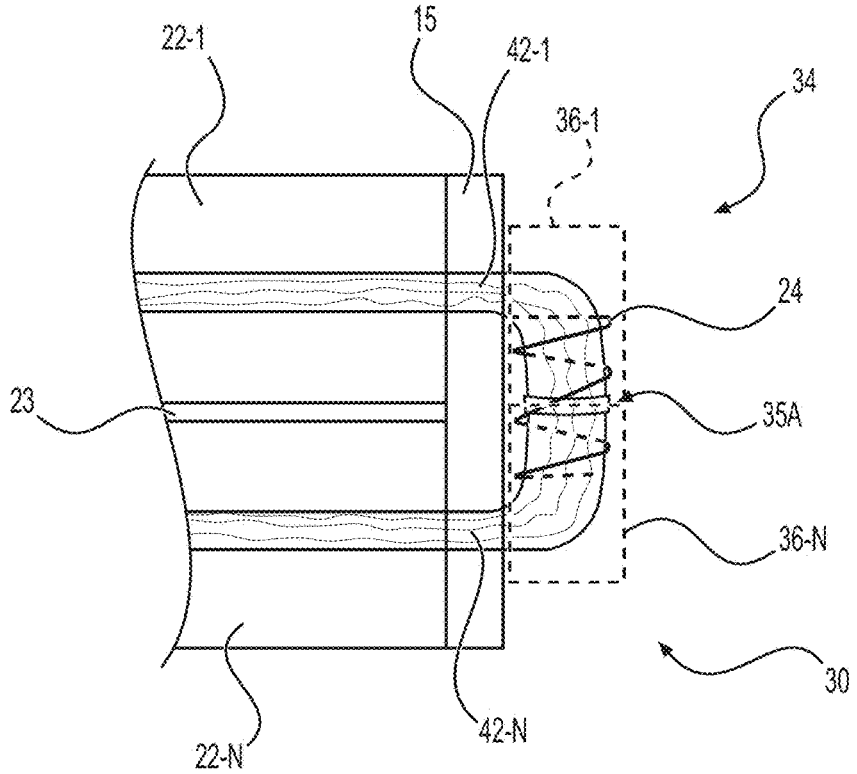
FIG. 2A is a dispensing interface according to some example embodiments.
Figure 2B:
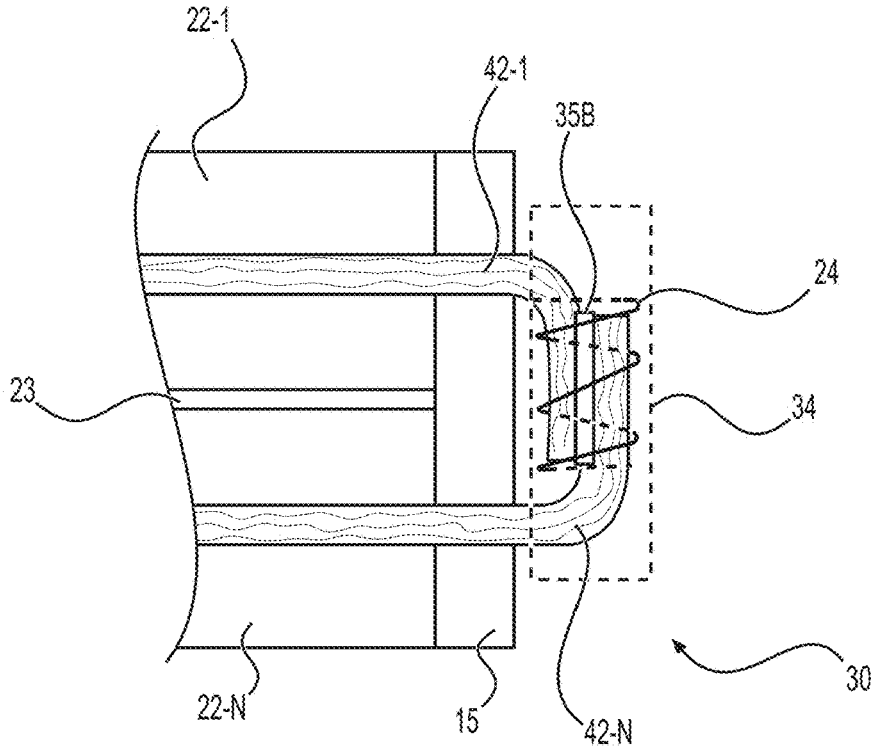
FIG. 2B is a dispensing interface according to some example embodiments.
Figure 2C:
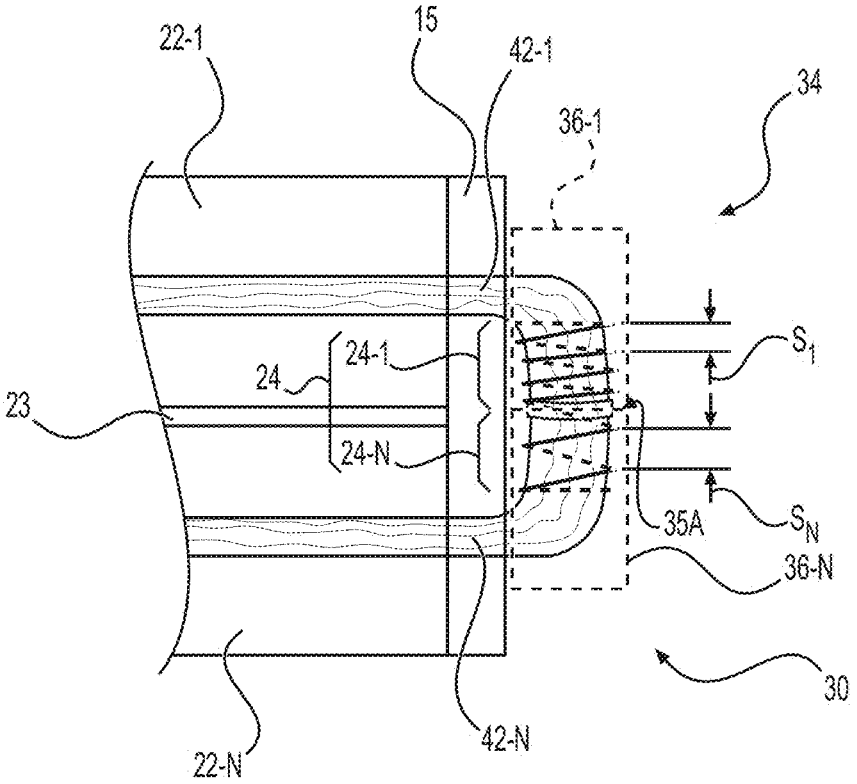
FIG. 2C is a dispensing interface according to some example embodiments.

FIGS. 2A and 2C show a dispensing interface 30 including a transverse divider according to some example embodiments. FIG. 2B shows a dispensing interface 30 including a parallel divider according to some example embodiments. The dispensing interfaces 30 shown in FIGS. 2A and 2C and FIG. 2B may be included in any of the embodiments of dispensing interfaces 30 included herein, including the dispensing interfaces 30 shown in FIG. 1B and FIG. 1C.

In some example embodiments, a dispensing interface 30 includes multiple wicks coupled together to form a trunk. The dispensing interface 30 may include a divider partitioning separate wicks from direct contact with each other, so that different pre-vapor formulations drawn to the trunk via separate wicks are restricted from mixing prior to vaporization of the different pre-vapor formulations. As a result, a risk of chemical reactions between the pre-vapor formulations is mitigated.

In some example embodiments, the divider may extend transverse to the end surfaces of separate wicks at the trunk. Such a divider may be referred to herein as a transverse divider. As shown in FIG. 2A, a dispensing interface 30 includes separate wicks 42-1 to 42-N extending into separate reservoirs 22-1 to 22-N and are coupled at respective end surfaces to form the trunk 34 of the dispensing interface 30. As shown in FIG. 2A, a transverse divider 35A may interpose between the end surfaces of the wicks 42-1 to 42-N, so that the transverse divider 35A extends transverse to the wicks 42-1 to 42-N at the trunk 34 and mitigates mixing of different pre-vapor formulations drawn to the trunk 34 by the separate wicks 42-1 to 42-N. As further shown in FIG. 2A, a heater 24 may be wrapped around a portion of the trunk 34, so that the heater 24 is wrapped around the transverse divider 35A.

In the example embodiment illustrated in FIGS. 2A and 2C, the heater 24 is a wire coil extending around the trunk 24 that includes portions of the separate wicks 42-1 to 42-N.

The illustrated wire coil of heater 24 includes a spacing between each of adjacent windings of the coil around the trunk 34.

In some example embodiments, including the example embodiments shown in FIG. 2C, a heater 24 that includes a wire coil winding around the trunk 34 includes separate portions 24-1 to 24-N coupled to separate portions 36-1 to 36-N of the trunk 34 that are formed of separate wicks 42-1 to 42-N. The separate portions 24-1 to 24-N of the wire coil may have different spacings $S_1$ to $S_N$ of the wire coil. The separate portions 24-1 to 24-N of the wire coil may be configured to provide different magnitudes of heating to the different portions 36-1 to 36-N of the trunk 34, based on the different spacings $S_1$ to $S_N$ of the wire coil in the separate portions 24-1 to 24-N of the heater 24. If and/or when the different portions 24-1 to 24-N of the heater 24 are coupled to different wicks 42-1 to 42-N, the different portions of the heater 24 may vaporize different pre-vapor formulations in the different wicks 42-1 to 42-N at different rates.

In some example embodiments, the divider may extend parallel to the side surfaces of separate wicks at the trunk. Such a divider may be referred to herein as a parallel divider. As shown in FIG. 2B, a dispensing interface 30 includes separate wicks 42-1 to 42-N extending into separate reservoirs 22-1 to 22-N and coupled at respective side surfaces to form the trunk 34. As shown in FIG. 2B, a parallel divider 35B may interpose between the side surfaces of the wicks 42-1 to 42-N, so that the parallel divider 35B extends in parallel to the wicks 42-1 to 42-N at the trunk 34 and mitigates mixing of different pre-vapor formulations drawn to the trunk 34 by the separate wicks 42-1 to 42-N. As further shown in FIG. 2B, a heater 24 may be wrapped around the trunk 34, so that the heater 24 is wrapped around the parallel divider 35B.

Figure 3:
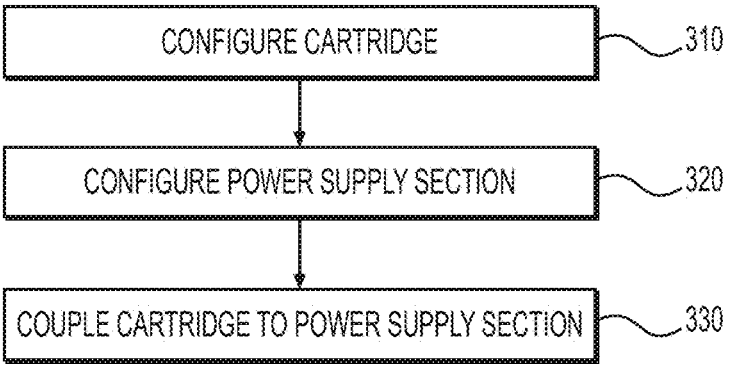
FIG. 3 is a flowchart illustrating a method for configuring an e-vaping device to provide a combined vapor, according to some embodiments.

FIG. 3 is a flowchart illustrating a method for configuring an e-vaping device to provide a combined vapor, according to some embodiments. The configuring may be implemented with regard to any of the embodiments of e-vaping devices included herein. In some example embodiments, one or more portions of the configuring are implemented by a configuror. The configuror may be one or more of a human operator, a machine, some combination thereof, etc. The machine may be a fabrication machine. The machine may be a special purpose machine configured to implement the configuring based on executing program code stored in a memory device.

Referring to FIG. 3, at 310, the configuror configures a cartridge (or first section) to provide a combined vapor based on simultaneous vaporization of different pre-vapor formulations at a common location within the cartridge. Such configuring is discussed in further detail below with regard to FIG. 4.

At 320, the configuror configures a power supply section (or second section) to provide electrical power. The configuring of the power supply section may include one or more of installing a power supply in the power supply section, charging a power supply in the power supply section, coupling a control circuitry to the power supply section, etc.

At 330, the configuror couples the cartridge and power supply section at complimentary interfaces, such that the power supply in the power supply section is electrically coupled to a heater included in the cartridge and may be operated to cause the heater to simultaneously heat different pre-vapor formulations drawn from separate reservoirs in the cartridge.

In some example embodiments, the cartridge may be replaced with a different cartridge, and the different cartridge may include a different set of pre-vapor formulations.

Figure 4:
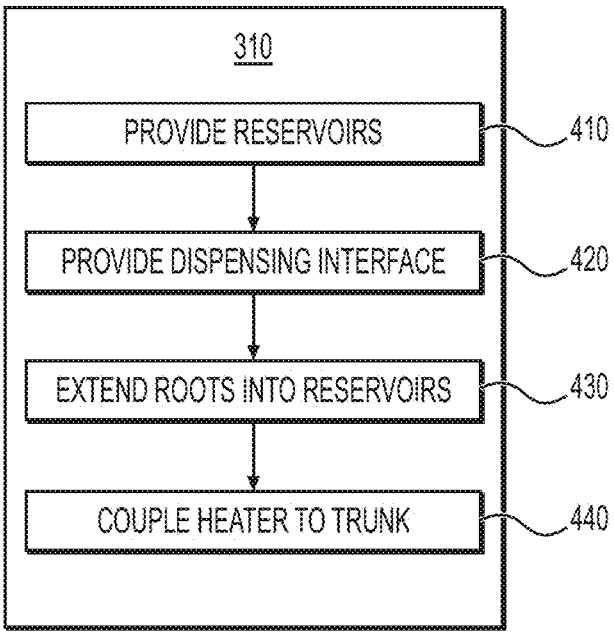
FIG. 4 is a flowchart illustrating a method for configuring a cartridge, according to some example embodiments.

FIG. 4 is a flowchart illustrating a method for configuring a cartridge, according to some example embodiments. The configuring 310 may be implemented with regard to any of the embodiments of e-vaping devices included herein. Such configuring includes configuring elements of a cartridge as shown with regard to the cartridge 70 in FIG. 1A, FIG. 1B, and FIG. 1C. In some example embodiments, one or more portions of the configuring are implemented by a configuror. The configuror may be one or more of a human operator, a machine, some combination thereof, etc. The machine may be a fabrication machine. The machine may be a special purpose machine configured to implement the configuring based on executing program code stored in a memory device.

Referring to FIG. 4, at 410, the configuror provides multiple reservoirs within a housing of the cartridge. The reservoirs may be bounded by separate housings. The reservoirs may be provided via partitioning a portion of the housing.

At 420, the configuror couples a dispensing interface to the separate reservoirs in the housing of the cartridge. Coupling the dispensing interface to the reservoirs may include extending 430 separate roots of the dispensing interface into separate reservoirs via the portions of the cartridge. In some example embodiments, the dispensing interface is coupled to a gasket, where the gasket seals one end of the reservoirs, so that the separate roots extend into the separate reservoirs through an interior of the gasket.

At 440, the configuror couples a heater to the trunk of the dispensing interface. The heater may be coupled to a power supply section interface of the cartridge via one or more sets of electrical leads, so that the heater may receive electrical power from a power supply coupled to the power supply section interface.

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A cartridge for an e-vaping device, the cartridge comprising:

a housing extending in a longitudinal direction;

a plurality of reservoirs positioned within the housing, the plurality of reservoirs extending in the longitudinal direction and configured to hold different pre-vapor formulations;

a dispensing interface coupled to the plurality of reservoirs, the dispensing interface including a plurality of separate wicks coupled together, the plurality of separate wicks each including absorbent material; and a heater coupled to the dispensing interface, wherein the dispensing interface includes a trunk that is a portion of the dispensing interface that includes coupled portions of the plurality of separate wicks and is surrounded by the heater, and a plurality of separate roots that include non-coupled portions of the plurality of separate wicks extending away from the trunk, the plurality of separate roots extending in the longitudinal direction into separate, respective reservoirs of the plurality of reservoirs, such that the dispensing interface is configured to draw the different pre-vapor formulations from the plurality of reservoirs into the trunk via the plurality of separate roots, wherein the heater is configured to vaporize the different pre-vapor formulations at a common rate simultaneously based on applying different magnitudes of heat to different portions of the trunk simultaneously, wherein the trunk includes one of the coupled portions of the plurality of separate wicks overlapping each other in the longitudinal direction, or the coupled portions of the plurality of separate wicks including respective end surfaces of the plurality of separate wicks, the respective end surfaces of the plurality of separate wicks facing each other in a direction transverse to the longitudinal direction.

2. The cartridge of claim 1, wherein the heater is a wire coil winding around the trunk, the wire coil including separate portions coupled to separate portions of the trunk, the separate portions of the wire coil having different spacings, the separate portions of the wire coil configured to provide different magnitudes of heat to different portions of the trunk simultaneously based on the different spacings of the separate portions of the wire coil.

3. The cartridge of claim 1, wherein the heater includes a plurality of separate heating elements, each separate heating element being coupled to a separate portion of the trunk, each separate heating element configured to generate a different magnitude of heat.

4. The cartridge of claim 1, further comprising:

a constrictor coupled to at least one root of the dispensing interface, the constrictor being configured to adjustably control a rate of transport at which the at least one root draws at least one pre-vapor formulation based on adjustably constricting a diameter of at least a portion of the at least one root to adjust a porosity of the portion of the at least one root.

5. The cartridge of claim 1, wherein the separate roots include different porosities.

6. The cartridge of claim 1, wherein the different pre-vapor formulations include different viscosities at a common temperature.

7. The cartridge of claim 1, wherein the plurality of separate wicks include different wicking materials, respectively.

8. The cartridge of claim 1, further comprising:

a divider assembly configured to partition at least two separate wicks of the plurality of separate wicks from direct contact with each other, the divider assembly being configured to mitigate pre-vaporization mixing of separate pre-vapor formulations drawn to the trunk via the at least two separate wicks.

9. The cartridge of claim 8, wherein the trunk includes the coupled portions of the plurality of separate wicks overlapping each other in the longitudinal direction, and the divider assembly is between side surfaces of the plurality of separate wicks in the longitudinal direction and extends in parallel to the plurality of separate wicks at the trunk.

10. An e-vaping device comprising:

the cartridge of claim 1; and a power supply section configured to selectively supply power to the cartridge.

11. The e-vaping device of claim 10, wherein the power supply section includes a rechargeable battery, the power supply section being removably coupled to the cartridge.

12. The cartridge of claim 8, wherein the trunk includes the coupled portions of the plurality of separate wicks including the respective end surfaces of the plurality of separate wicks facing each other in the direction transverse to the longitudinal direction, and the divider assembly is between the respective end surfaces of the plurality of separate wicks in the direction transverse to the longitudinal direction and extends transverse to the coupled portions of the plurality of separate wicks at the trunk.

* * * * *